US007949263B2

(12) United States Patent
Nakamura

(10) Patent No.: US 7,949,263 B2
(45) Date of Patent: May 24, 2011

(54) IMAGE FORMING APPARATUS HAVING MAINTENANCE METHOD SETTING FUNCTION

(75) Inventor: Hiroaki Nakamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/584,330

(22) Filed: Sep. 2, 2009

(65) Prior Publication Data

US 2010/0067935 A1 Mar. 18, 2010

(30) Foreign Application Priority Data

Sep. 17, 2008 (JP) ..... 2008-238279

(51) Int. Cl.
*G03G 15/00* (2006.01)

(52) U.S. Cl. ..... 399/9; 399/8; 399/11; 399/24

(58) Field of Classification Search ..... 399/8–11, 399/23, 24, 27

See application file for complete search history.

(56) References Cited

U.S. PATENT DOCUMENTS

2008/0025734 A1* 1/2008 Kehoe et al. ..... 399/8
2008/0075488 A1 3/2008 Moriyama et al.

FOREIGN PATENT DOCUMENTS

JP 2001-166644 6/2001
JP 2004-144994 5/2004

* cited by examiner

*Primary Examiner* — Hoang Ngo
(74) *Attorney, Agent, or Firm* — Edwards Angell Palmer & Dodge LLP; David G. Conlin

(57) ABSTRACT

An image forming apparatus of which maintenance work can always be conducted appropriately independent of time-degradation of the apparatus is provided. In the image forming apparatus of which maintenance work is done in accordance with either a user mode or a service engineer mode, an image forming unit including an image forming station prints an image in accordance with image data, and a main CPU calculates duration of use of the apparatus as an index indicating time-degradation, and determines whether or not the calculated duration of use of the apparatus has reached one year as a predetermined threshold value. Based on the result of determination, a user mode or a service engineer mode is set as a maintenance method for conducting maintenance work.

15 Claims, 13 Drawing Sheets

IMAGE FORMING APPARATUS HAVING MAINTENANCE METHOD SETTING FUNCTION

CROSS-REFERENCE TO RELATED APPLICATION

This nonprovisional application claims priority under 35 U.S.C. §119(a) on Patent Application No. 2008-238279 filed in Japan on Sep. 17, 2008, the entire contents of which are hereby incorporated by reference.

BACKGROUND OF THE INVENTION

1. Field of the Invention

The present invention relates to an image forming apparatus of which maintenance work is done in accordance with a maintenance method that is set in advance and, more specifically, to a technique of improving efficiency of the maintenance work.

2. Description of the Background Art

The method of conducting maintenance work of image forming apparatuses is determined apparatus by apparatus. By way of example, for a certain image forming apparatus, all maintenance works are done by a user. For another apparatus, an expert worker called customer service engineer dispatched from a manufacturer does all the maintenance works. For yet another apparatus, a user replaces consumable supplies, while a service engineer cleans components.

For determining a timing of conducting maintenance work, Japanese Patent Laying-Open No. 2001-166644 (hereinafter referred to as "'644 reference") discloses a method of remote maintenance for remote trouble-shooting of image forming apparatuses. According to the method of remote maintenance, a set value, for example, of a jam rate as a reference for determining remote maintenance is changed in consideration of actual market condition. According to '644 reference, it is possible to prevent decrease in work efficiency of the user caused by a trouble of the image forming apparatus.

Image forming apparatuses degrade with time, as they are used over a long period of time. Because of time-degradation, time interval of replacing consumable supplies may become shorter and inside of the apparatuses tends to be more easily contaminated. By the method disclosed in '644 reference, it is impossible to conduct maintenance work responding to the time-degradation. Appropriate maintenance work may not be conducted even if maintenance becomes necessary due to time-degradation.

SUMMARY OF THE INVENTION

An object of the present invention is to provide an image forming apparatus that always allows appropriate maintenance work regardless of the time-degradation of the apparatus.

According to an aspect, the present invention provides an image forming apparatus, of which maintenance work is conducted in accordance with any of a plurality of maintenance methods, including: an output device printing an image on a recording medium in accordance with image data; a calculating unit calculating a value as an index indicating degradation with time; a determining unit determining whether or not the value calculated by the calculating unit has reached a predetermined threshold value; and a setting unit setting, based on the result of determination by the determining unit, any of the plurality of maintenance methods as the maintenance method of conducting the maintenance work.

As described above, based on a result of determination as to whether a value as an index indicating time-degradation has reached a predetermined threshold value or not, any one of the plurality of maintenance methods is set as the method of conducing the maintenance work. Therefore, it is possible to always conduct appropriate maintenance work independent of the time-degradation of the apparatus.

Preferably, the calculating unit includes a calculating circuit calculating duration of use of the apparatus as the index indicating degradation with time. Therefore, it is possible to always conduct appropriate maintenance work independent of the duration of use of the apparatus.

More preferably, the calculating unit includes a calculating circuit calculating quantity of prints by the output device as the index indicating degradation with time. Therefore, it is possible to always conduct appropriate maintenance work independent of the printing quantity by the output apparatus.

More preferably, the image forming apparatus further includes: a detecting unit detecting a timing when the maintenance work is due, in accordance with the maintenance method set by the setting unit; a display device displaying information; and a display control unit causing the display device to display information related to the set maintenance method, if a timing when the maintenance work is due is detected by the detecting unit.

As described above, upon detection of the timing when the maintenance work in accordance with the set maintenance method is due, the information related to the set maintenance information is displayed. As a result, the user can easily know the timing when the maintenance work is due. Therefore, it is possible to always conduct appropriate maintenance work, with higher reliability.

More preferably, the detecting unit includes a detecting circuit detecting, as the timing when the maintenance work is due, at least a timing when a component is to be replaced, or a component is to be cleaned; and the display control unit includes a control circuit causing the display device to display information related at least to replacement or cleaning of a component, if at least the timing when a component is to be replaced or the timing when a component is to be cleaned is detected by the detecting circuit.

As described above, when at least one of the timing of replacing a component and the timing of cleaning a component is detected, at least a piece of information related at least to one of the replacement of a component and the cleaning of a component is displayed. As a result, the user can easily know at least one of the timing of replacing a component and the timing of cleaning a component. Therefore, it is possible to always conduct appropriate work of replacing a component and appropriate work of cleaning a component.

More preferably, the setting unit includes a setting circuit for setting, as the maintenance method of conducting the maintenance work, a user mode in which the user conducts the maintenance work, among the plurality of maintenance methods, and the display control unit causes the display device to display information related to work procedure of the maintenance, when the user mode is set as the maintenance method of conducting the maintenance work by the setting circuit and the timing when the maintenance work is due is detected by the detecting unit.

As described above, when the user mode is set and the timing when maintenance is due is detected, the information related to the work procedure of maintenance is displayed. Therefore, it is possible to always conduct more appropriate maintenance work independent of time-degradation of the apparatus.

More preferably, the setting unit includes a setting circuit setting, as the maintenance method of conducting the maintenance work, either a user mode in which the user conducts the maintenance work, or a service engineer mode in which a service engineer as an expert conducts the maintenance work, among the plurality of maintenance methods, based on a result of determination by the determining unit. As a result, the user mode or the service engineer mode is set based on the result of determination by the determining unit as to whether the value as an index indicating time-degradation has reached the predetermined threshold value or not. Therefore, it is possible to always conduct more appropriate maintenance work independent of time-degradation of the apparatus.

More preferably, the setting circuit sets the service engineer mode as the maintenance method of conducting the maintenance work if it is determined by the determining unit that the value calculated by the calculating unit has reached the predetermined threshold value, and sets the user mode as the maintenance method of conducting the maintenance work if it is determined by the determining unit that the value calculated by the calculating unit has not yet reached the predetermined threshold value.

As described above, if it is determined that the value as an index indicating time-degradation has reached the predetermined threshold value, the service engineer mode is set, and if it is determined that the value as the index indicating time-degradation has not reached the predetermined threshold value, the user mode is set. Therefore, it is possible to always conduct more appropriate maintenance work independent of time-degradation of the apparatus.

More preferably, the image forming apparatus further includes a control unit controlling an operation of the output device; wherein the control unit decreases speed of printing operation by the output device, when the service engineer mode is set as the maintenance method of conducting the maintenance work by the setting circuit.

As described above, when the service engineer mode is set, the speed of printing operation by the output device is made slower. Therefore, it is possible to have the user more acutely aware of the necessity of maintenance. As a result, convenience of use of the apparatus can further be improved.

More preferably, the image forming apparatus further includes a receiving unit receiving an instruction from an external device designating the maintenance method; wherein the setting unit includes a method setting circuit setting any of the plurality of maintenance methods as the maintenance method of conducting the maintenance work, based on the instruction from the external device.

As described above, any of the plurality of maintenance methods is set as the maintenance method for conducting the maintenance work, based on an instruction from the external device. Therefore, it is possible to always conduct more appropriate maintenance work independent of time-degradation of the apparatus and independent of other conditions.

According to the present invention, any of the plurality of maintenance methods is set as the maintenance method for conducting the maintenance work, based on the result of determination as to whether the value as an index indicating time-degradation has reached the predetermined threshold value or not. Therefore, an image forming apparatus allowing appropriate maintenance work independent of the time-degradation of the apparatus can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
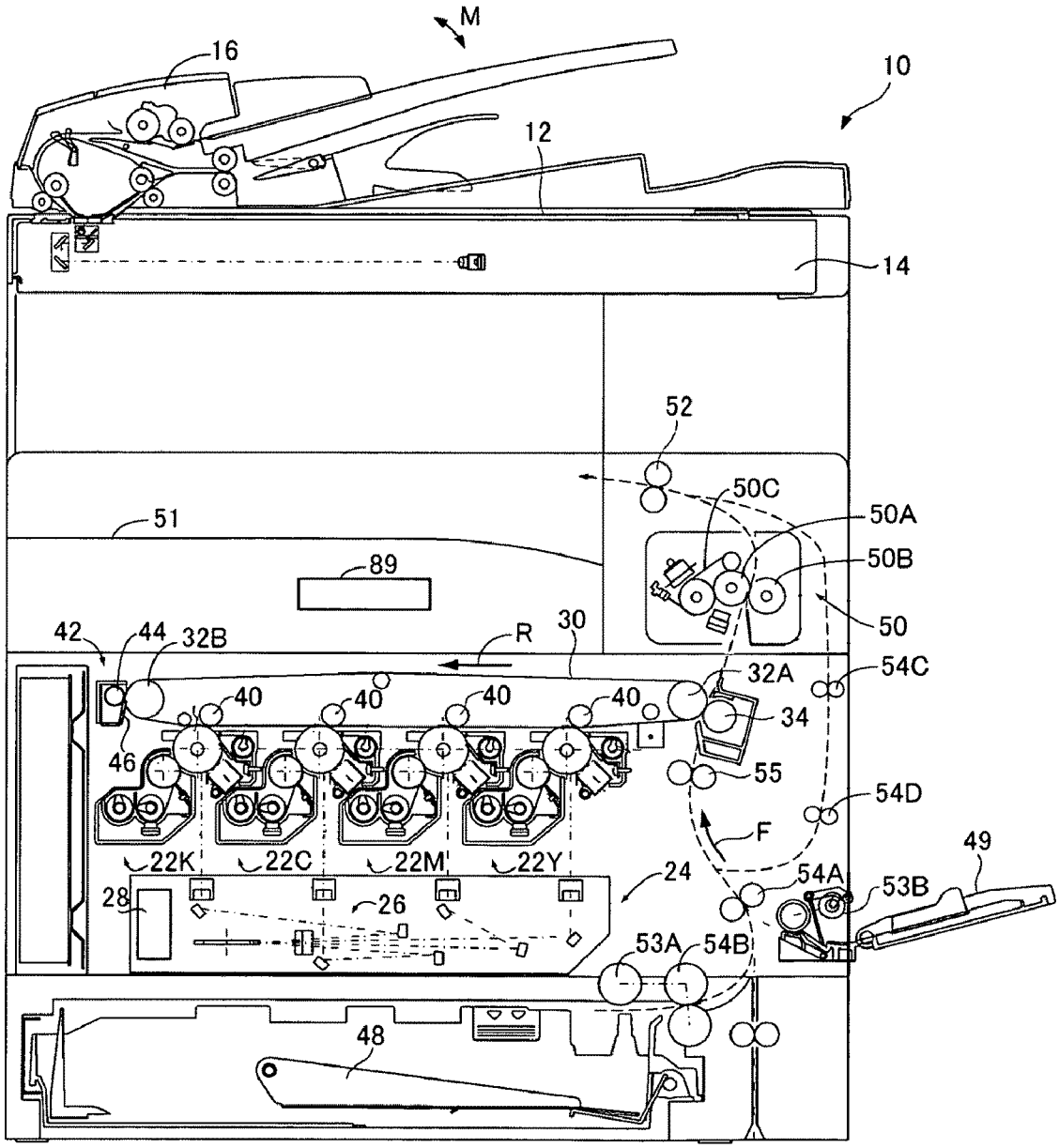
FIG. 1 schematically shows an internal structure of an image forming apparatus in accordance with an embodiment of the present invention.

In the following description and in the drawings, the same components are denoted by the same reference characters and same names. Their functions are also the same. Therefore, detailed description thereof will not be repeated every time.

An image forming apparatus 10 in accordance with the present embodiment is a digital multi-functional printer for printing images of single or multiple colors in accordance with image data transmitted from an external device on a prescribed sheet (sheet of recording paper).

In image forming apparatus 10 in accordance with the present embodiment, maintenance work is conducted in accordance with two maintenance methods including a user mode and a service engineer mode. Here, the user mode refers to an operation mode in which maintenance work by the user is recommended. The service engineer mode refers to a mode in which maintenance by a service engineer as an expert worker is recommended. These modes are switched in accordance with an instruction from a management server 94, which will be described later, or based on a determination using a value as an index indicating time-degradation of the apparatus. In the present embodiment, the value as an index of time-degradation is duration of use of the apparatus, that is, the elapsed time period from the initial operation of image forming apparatus 10 (from when the apparatus was first operated). Specifically, if the duration of use of image forming apparatus 10 is not longer than one year, the user mode is set as the maintenance method, and if the duration of use is one year or longer, the service engineer mode is set as the maintenance method. Further, in the present embodiment, components as the objects of maintenance include a transfer unit, a fixing unit 50, a drum unit, a developer unit 64, a toner cartridge, and a waste toner recovery container 78, which will be described later. In the following, maintenance of these components will be described, together with the hardware configuration of image forming apparatus 10.

<Hardware Configuration>

—Overall Configuration—

Referring to FIG. 1, image data printed by image forming apparatus 10 corresponds to a color image using each of black (K), cyan (C), magenta (M) and yellow (Y). Therefore, image forming apparatus 10 includes image forming stations 22K, 22C, 22M and 22Y for forming a black toner image, a cyan toner image, a magenta toner image and yellow toner image, respectively. In the following description, image forming stations 22K, 22C, 22M and 22Y may be generally referred to as an "image forming station 22." Details of the structure of image forming station 22 will be described later.

Image forming apparatus 10 further includes a platen 12 provided at an upper portion of image forming apparatus 10, an automatic document feeder (hereinafter denoted as "ADF") 16 attached to platen 12 to be opened/closed in a direction denoted by an arrow M, and a document reading unit 14 provided below platen 12. Platen 12 is a plate-shaped member formed of transparent glass for receiving a document. ADF 16 is a device for automatically feeding a document to platen 12. It is also possible for the user to place a document manually on platen 12, by opening ADF 16 in the direction of arrow M.

Document reading unit 14 is a scanner including, for example, a CCD (Charge Coupled Device) line sensor (not shown). Document reading unit 14 reads image information of the document placed on platen 12 manually by the user or by ADF 16, and outputs the read image information as digital image data to an image processing unit 89.

Image processing unit 89 performs image processing including screening process (gradation process) on the input image data and thereby forms image data of a prescribed tone gradation, which is output to an LSU controller 28.

Image forming apparatus 10 further includes a laser scanner unit (hereinafter denoted as "LSU") 24 provided below image forming station 22 for performing exposure of image forming station 22 by laser scanning. LSU 24 includes a laser oscillation unit 26 including a semiconductor laser for oscillating a laser beam, a polygon mirror for laser beam scanning, optical elements such as a lens and a reflection mirror for guiding the laser beam reflected from the polygon mirror to a surface of a photoreceptor drum 60 (not shown in FIG. 1), and an LSU controller 28 for converting the image data output from image processing unit 89 to laser emission signals and for controlling the operation of laser oscillation unit 26 based on the laser emission signals. Though LSU 24 is used in the present embodiment, an array of light emitting elements such as EL (Electro Luminescence) or LED (Light Emitting Diode) write heads may be used.

Image forming apparatus 10 further includes an intermediate transfer belt 30 provided above image forming station 22 for transferring single color toner images formed at each of the image forming stations 22 overlapped one after another on a sheet of recording paper as a recording medium, and two support rollers 32A and 32B provided spaced apart in the left/right direction on the drawing sheet inside intermediate transfer belt 30, for supporting intermediate transfer belt 30. Intermediate transfer belt 30 is a member having the shape of an endless belt, wrapped around two support rollers 32A and 32B. Intermediate transfer belt 30 is not specifically limited, and any one generally used in the field of art may be used. By way of example, a film or the like having the thickness of 100 μm to 150 μm may be used. Support roller 32A (on the right side of FIG. 1) is provided rotatable about an axial line driven by a driving unit (not shown), and as it rotates, the support roller rotates intermediate transfer belt 30 in a direction indicated by an arrow R, that is, in the counter-clockwise direction on the drawing. Support roller 32B (on the left side of FIG. 1) is provided to rotate, following the rotation of support roller 32A, to apply a constant tensile force on intermediate transfer belt 30 so as to prevent sagging of intermediate transfer belt 30.

On the other side of intermediate transfer belt 30 opposite to support roller 32A, a transfer roller 34 is provided, to from a pair with support roller 32A. In the following description, with respect to the direction of rotation of intermediate transfer belt 30, a secondary transfer position (transfer nip portion) as the portion where support roller 32A and transfer roller 34 are in pressure contact with each other is used as a reference position to indicate an upstream side and a downstream side. Image forming stations 22K, 22C, 22M and 22Y are arranged in this order, from the upstream to the downstream side in the rotating direction of intermediate transfer belt 30 indicated by the arrow R.

Preferably, either one of transfer roller 34 and support roller 32A is formed of a hard material such as metal and, for the other one, an elastic roller formed of a soft material, such as an elastic rubber roller or a resin foam roller, is used. This constantly provides the transfer nip portion. When a sheet (recording paper) is fed to the transfer nip portion, a high voltage of a polarity (+) opposite to the toner charging polarity (−) is applied to transfer roller 34. Thus, the full-color toner image formed on intermediate transfer belt 30 is transferred to the sheet (recording paper).

Image forming apparatus 10 further includes, inside the intermediate transfer belt 30, four intermediate transfer rollers 40, provided opposite to image forming stations 22K, 22C, 22M and 22Y, respectively, for transferring single-color toner images formed at image forming stations 22K, 22C, 22M and 22Y to intermediate transfer belt 30. When a transfer bias as a high voltage having the polarity opposite to the toner charging polarity (for example, polarity (+) opposite to the toner charging polarity (−)) is applied from each of intermediate transfer rollers 40, single color toner images formed at image forming stations 22K, 22C, 22M and 22Y, respectively, are transferred overlapped one after another on intermediate transfer belt 30, forming one full-color toner image. The intermediate transfer roller 40 is not specifically limited and any roller generally used in the field of art may be used. By way of example, a roller having a metal shaft of 8 mm to 10 mm in diameter, formed of stainless steel or the like as a base and its surface covered by a conductive elastic material (for example, ethylene propylene rubber (EPDM) or urethane foam) may be used. By using such a conductive elastic material, it becomes possible to apply uniform transfer bias to intermediate transfer belt 30. Though a roller-shaped member is used as a transfer electrode in the present embodiment, a brash-shaped member or the like may be used.

Image forming apparatus 10 further includes the above-described transfer roller 34 provided on the downstream side in the rotating direction of intermediate transfer belt 30 than image forming station 22Y, for transferring the full-color toner image formed on intermediate transfer belt 30 to the recording paper, and a belt cleaning unit 42 provided on the downstream side in the rotating direction of intermediate transfer belt 30 than transfer roller 34, for cleaning the surface of intermediate transfer belt 30.

Belt cleaning unit 42 includes a belt cleaning brush 44 and a belt cleaning blade 46, which are in contact with the surface of intermediate transfer belt 30, for removing toner left on the surface of intermediate transfer belt 30 and causing undesirable color mixture of toner. Belt cleaning blade 46 is arranged on the downstream side in the direction of rotation of intermediate transfer belt 30 than belt cleaning brush 44. On the other side of intermediate transfer belt 30 opposite to belt cleaning blade 46, support roller 32B is positioned.

Intermediate transfer belt 30, support rollers 32A and 32B, intermediate transfer roller 40 and belt cleaning unit 42 described above form a transfer unit. It is possible for the user to roughly clean the transfer unit and, when the user mode is set, the user cleans the transfer unit. On the other hand, if the apparatus is degraded with time and the service engineer mode is set, a service engineer conducts maintenance work including cleaning with parts removed and adjustment for recovering degraded functions.

Image forming apparatus 10 further includes a tray 48 provided below LSU 24, for containing sheets (recording paper) therein, a pick-up roller 53A, a plurality of paper feed roller pairs (in the present embodiment, four pairs) 54A to 54D, and a register roller 55, for feeding sheets of paper in tray 48 to a paper feed path. Paper feed roller pair 54 is a pair of small rollers provided along the paper feed path, which promote and help feeding of a sheet. Pick-up roller 53 A is provided close to an end of tray 48, and it picks up and feeds sheets one by one from tray 48 to the paper feed path. Register roller 55 temporarily holds the sheet conveyed on the paper feed path, and feeds the sheet to transfer roller 34 at a timing when the tip end of toner image on intermediate transfer belt 30 and the tip end of the sheet are registered. The sheet of recording paper contained in tray 48 is fed to the secondary transfer position (transfer nip portion) by the rollers including the paper feed roller pairs 54 mentioned above. The direction of feeding recording paper (hereinafter referred to as "paper feed direction") is indicated by an arrow F. The sheet used for image formation may be placed in a manual feed cassette 49. A pick-up roller 53B provided close to an end of manual feed cassette 49 picks up and feeds the sheets one by one from manual feed cassette 49 to the paper feed path.

Image forming apparatus 10 further includes a fixing unit 50 provided on the downstream side in the paper feed direction indicated by arrow F than transfer roller 34, for fixing the full-color toner image transferred to the recording paper on the recording paper, and a paper discharge roller 52 provided on the further downstream side in the paper feed direction than fixing unit 50, for discharging the recording paper on which the full-color image has been fixed, from image forming apparatus 10 to a paper discharge tray 51. Paper discharge tray 51 is provided at an upper portion of image forming apparatus 10, for stacking face-down the printed sheets.

Fixing unit 50 includes a heat roller 50A, a pressure roller 50B, and an external heating belt 50C. Heat roller 50A is a roller-shaped member provided rotatable about an axial line by a driving unit (not shown). Pressure roller 50B is a roller-shaped member, which is brought into pressure-contact with heat roller 50A by a pressurizing member (not shown). Pressure roller 50B rotates following the rotation of heat roller 50A. External heating belt 50C is a member having the shape of an endless belt, for heating the surface of heat roller 50A from outside. Inside the heat roller 50A, a heating member such as a halogen lamp (not shown) is provided, for heating the surface of heat roller 50A. The heating member and external heating belt 50C are subjected to temperature control by a main CPU 80, which will be described later, based on a signal from a temperature detector (not shown), such that prescribed fixing temperature is attained. In the following, the portion where heat roller 50A and pressure roller 50B are in pressure contact with each other will be referred to as a fixing nip portion. When a sheet (recording paper) on which the toner image has been transferred by the transfer unit passes through the fixing nip portion, fixing unit 50 heats and melts the toner forming the toner image and presses it to the sheet (recording paper), whereby the toner image is thermally fixed on the recording medium and the image is formed.

Fixing unit 50 further includes a cleaner (not shown) for removing any residue including the toner adhered on the surface of heat roller 50A. The cleaner may be replaced by the user, and when the user mode is set, the cleaner is replaced by the user. On the other hand, if the apparatus is degraded with time and the service engineer mode is set, a service engineer conducts maintenance work including replacement of the cleaner and other parts, cleaning of each part, and if the apparatus is considerably degraded, replacement of fixing unit 50 as a whole.

Image forming apparatus 10 further includes an operation panel 91 (not shown in FIG. 1) formed by superposing a display device such as a liquid crystal display and an input device such as a touch-panel. Operation panel 91 receives a user instruction related to the overall operation of image forming apparatus 10, displays contents of the instruction, and outputs a control signal in accordance with the instruction to main CPU 80, which will be described later.

In image forming apparatus 10, the single-color images formed at image forming stations 22K, 22C, 22M and 22Y are primary-transferred, overlapped successively on intermediate transfer belt 30, whereby a full-color toner image is formed. The full-color toner image formed on intermediate transfer belt 30 is secondary-transferred to the sheet of recording paper fed by paper feed roller pairs 54 at the secondary transfer position (transfer nip portion), and thereafter fixed on the recording paper by fixing unit 50. The recording paper on which the full-color image has been formed by fixing unit 50 is discharged by discharge roller 52 from image forming apparatus 10. Further, the toner not transferred to the recording paper but left on intermediate transfer belt 30 after secondary transfer is removed by belt cleaning unit 42.

When double-sided printing is to be done, when printing on one side ends and the rear end of the sheet that has passed through fixing unit 50 is held by discharge roller 52, the discharge roller 52 rotates in the reverse direction to feed the sheet to paper feed roller pairs 54C and 54D. Then, the sheet is passed through register roller 55 and printing is done on the rear side, and thereafter, the sheet is discharged to discharge tray 51.

—Structure of Image Forming Station 22—

Image forming stations 22K, 22C, 22M and 22Y have the same structure except that the toners contained in developer tanks 68, which will be described later, are of different colors. In the following, the structure of image forming station 22K will be described as a representative.

Figure 2:
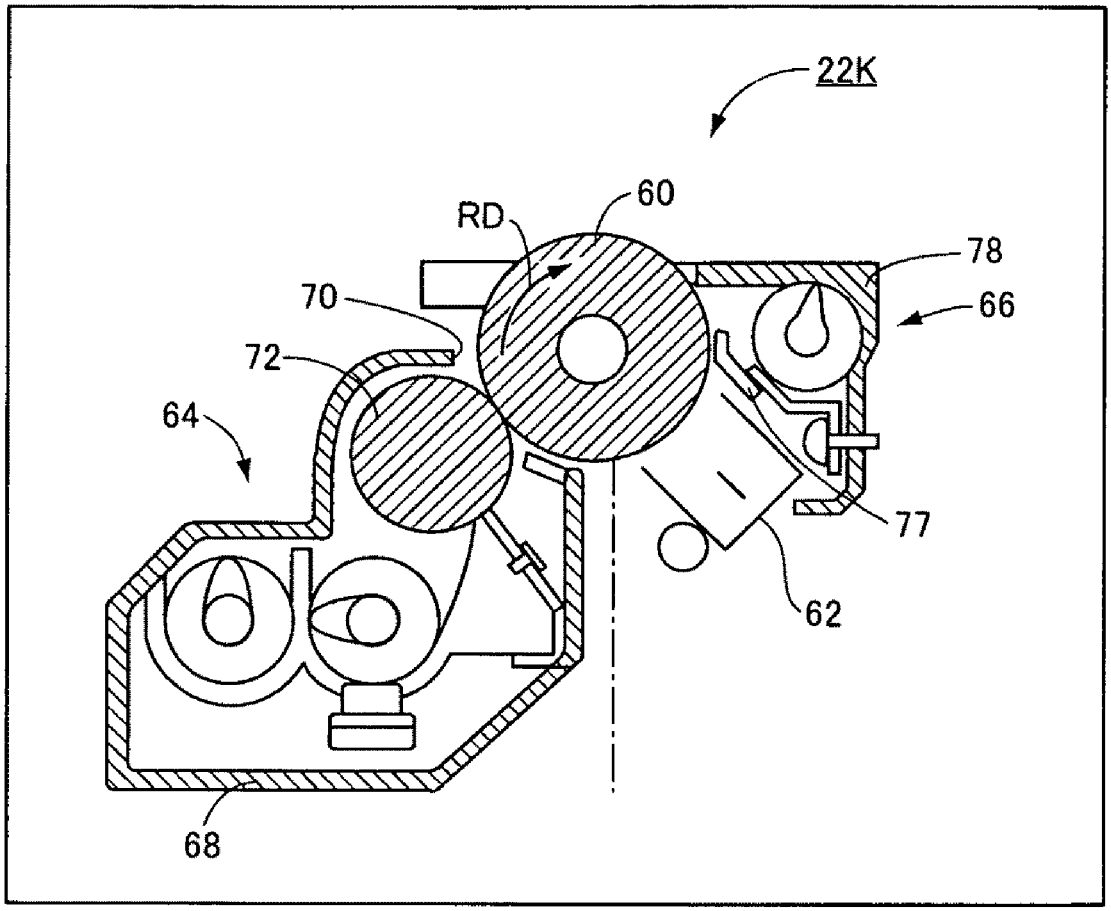
FIG. 2 is a cross-sectional view schematically showing a structure of an image forming station.

Referring to FIG. 2, image forming station 22K includes a photoreceptor drum 60, a charger 62 for uniformly charging the surface of photoreceptor drum 60, a developer unit 64 for visualizing an electrostatic latent image formed on the surface of photoreceptor drum 60, and a photoreceptor drum cleaner 66 for removing residue including toner left on the surface of photoreceptor drum 60.

Photoreceptor drum 60 is provided rotatable about an axis, by a driving unit (not shown). As it is driven to rotate, photoreceptor drum 60 rotates in a direction indicated by an arrow RD, that is, in the clockwise direction in the drawing. Photoreceptor drum 60 and various components such as the driving unit for attaining the function of photoreceptor drum 60 constitute a drum unit. Maintenance of the drum unit is not easy enough for a user and, therefore, when the user mode is set, maintenance of the drum unit is not conducted. On the other hand, if the apparatus is degraded with time and the service engineer mode is set, a service engineer conducts maintenance work including cleaning with chemicals such as alcohol, and replacement of drum unit, as needed.

Charger 62, developer unit 64 and photoreceptor drum cleaner 66 are provided around photoreceptor drum 60 in this order along the rotating direction of photoreceptor drum 60 indicated by arrow RD. Developer unit 64 is provided to be positioned below charger 62, and photoreceptor drum cleaner 66 is provided to be positioned above charger 62.

Charger 62 is implemented by a non-contact type scorotron charger. Charger 62 performs corona discharge on photoreceptor drum 60, so that the surface of photoreceptor drum 60 is charged uniformly to a prescribed potential. Charger 62 is not limited to a scorotron charger and any one generally used in the field of art may be used. By way of example, a non-contact type corotron charger, or a contact type charger including a charge roller or charge brush may be used. The surface of photoreceptor drum 60 uniformly charged to the prescribed potential by charger 62 is exposed through laser scanning by laser oscillation unit 26 shown in FIG. 1, whereby an electrostatic latent image based on the image data is formed on the surface of photoreceptor drum 60.

Developer unit 64 includes a developer tank 68 for containing therein a two-component developer including toner and carrier. On a side surface of developer tank 68, at a position facing the surface of photoreceptor drum 60, an opening 70 is formed. Developer unit 64 further includes a developing roller 72. Developing roller 72 is provided rotatable about an axis by a driving unit (not shown), in developer tank 68, at a position opposite to photoreceptor drum 60 with opening 70 positioned therebetween. Developing roller 72 is provided spaced by a prescribed distance from the surface of photoreceptor drum 60, and when driven to rotate, it rotates in the same direction as the rotation of photoreceptor drum 60 at the portion closest to the photoreceptor drum 60. Developing roller 72 carries and conveys the two-component developer on its surface and supplies the toner to the electrostatic latent image formed on the surface of photoreceptor drum 60 at the portion closest to the photoreceptor drum 60, so that the electrostatic latent image is developed. When the toner is supplied, a potential of the polarity opposite to the toner charging potential is applied as a developing bias voltage, to the surface of developing roller 72. Thus, the toner on the surface of developing roller 72 is supplied smooth to the electrostatic latent image. The toner contained in developer tank 68 is supplied from a toner cartridge (not shown) detachably attached close to developer unit 64.

It is possible for the user to roughly clean the developer unit 64 and, when the user mode is set, the user cleans developer unit 64. On the other hand, if the apparatus is degraded with time and the service engineer mode is set, a service engineer conducts maintenance work including cleaning with parts removed and adjustment for recovering degraded functions.

The toner cartridge can be exchanged easily by the user and it frequently requires exchange. Therefore, when the user mode is set, it is exchanged by the user. On the other hand, if the apparatus is degraded with time, frequency of maintenance work including cleaning and replacement of various components in the apparatus increases and, as a result, maintenance of various components at one time becomes more efficient. Therefore, when the service engineer mode is set, the service engineer exchanges the toner cartridge, simultaneously with the maintenance work on other components.

Photoreceptor drum cleaner 66 includes a cleaning blade 77 for scraping off any residue including toner left on the surface of photoreceptor drum 60, and a waste toner recovery container 78 for holding and preventing scattering of the residue removed by cleaning blade 77. Cleaning blade 77 is a plate-shaped member provided with its longitudinal direction extending in the axial direction of photoreceptor drum 60, and it is arranged in waste toner recovery container 78 such that its one end in the shorter side direction is bent in the counter direction to the rotating direction of photoreceptor drum 60 (direction reverse to the rotating direction of photoreceptor drum 60) and in pressure contact with the photoreceptor drum 60 at a position where the rotating direction of photoreceptor drum 60 is downward. By such an arrangement, it becomes easier to scrape off the residue at the one end in the shorter side direction.

The waste toner recovery container 78 can be exchanged easily by the user and it frequently requires exchange. Therefore, when the user mode is set, it is exchanged by the user. On the other hand, if the apparatus is degraded with time, frequency of maintenance work including cleaning and replacement of various components in the apparatus increases and, as a result, maintenance of various components at one time becomes more efficient. Therefore, when the service engineer mode is set, the service engineer exchanges waste toner recovery container 78, simultaneously with the maintenance work on other components.

At image forming station 22K, the surface of photoreceptor drum 60 uniformly charged by charger 62 is irradiated with laser beam based on the image data emitted from LSU 24, whereby electrostatic latent image is formed. Toner is supplied from developer unit 64 to the formed electrostatic latent image, so that a single-color toner image is formed, which is primary-transferred to intermediate transfer belt 30. After the primary transfer, residue left on the surface of photoreceptor drum 60 is removed by photoreceptor drum cleaner 66. The series of toner image forming operations is repeatedly executed at image forming stations 22K, 22C, 22M and 22Y.

<Electrical Configuration>

Figure 3:
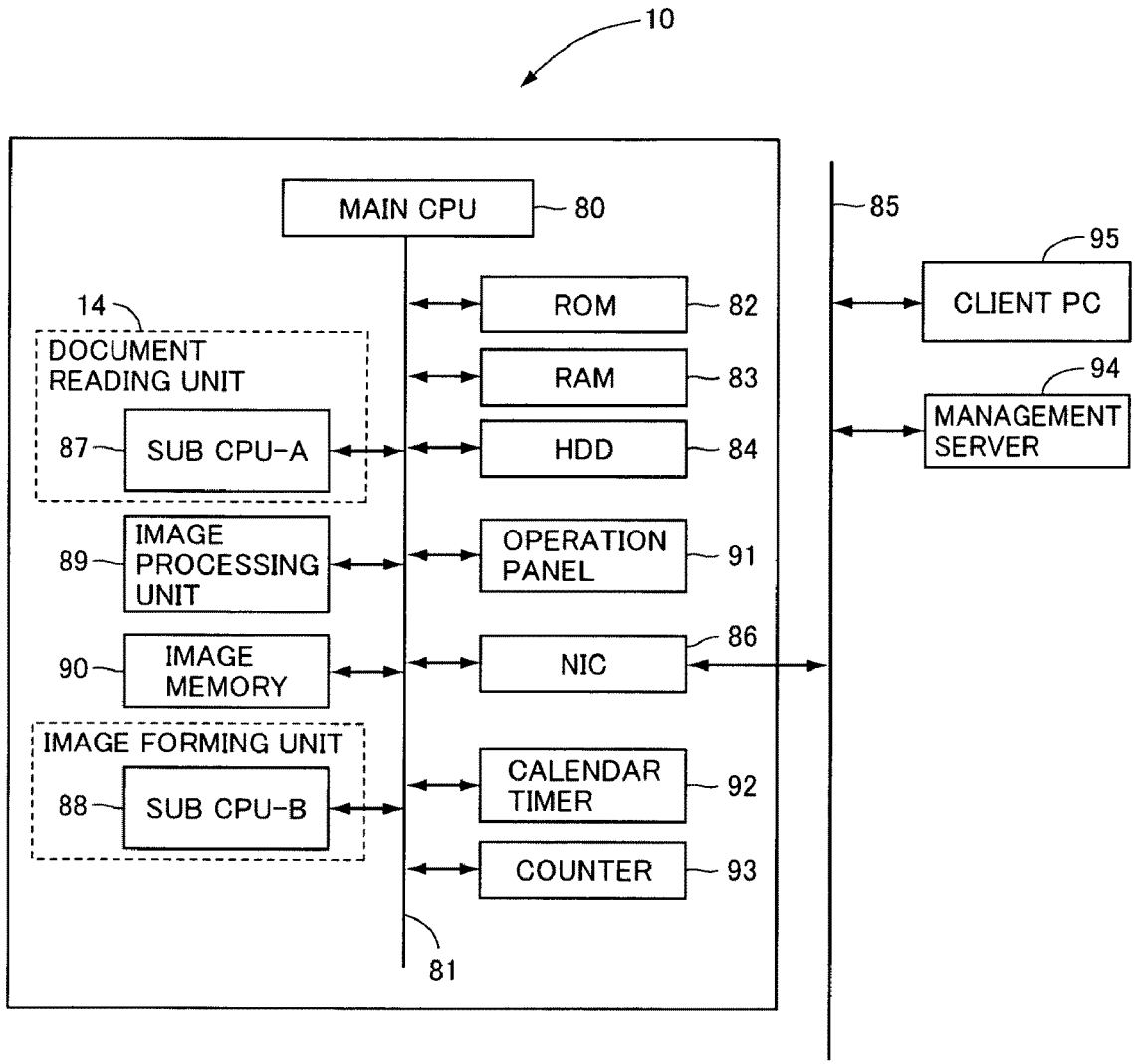
FIG. 3 is a block diagram showing electrical configuration of the image forming apparatus together with some hardware.

Referring to FIG. 3, image forming apparatus 10 includes a main CPU 80. Main CPU 80 is connected to bus line 81. Through bus line 81, an ROM (Read-Only Memory) 82, an RAM (Random Access Memory) 83 and an HDD (Hard Disk Drive) 84 are electrically connected to main CPU 80. ROM 82 is a read-only memory storing a computer program (hereinafter also simply referred to as a "program") for executing and controlling operations of various components of image forming apparatus 10. RAM 83 is a memory for temporary storage, in which a program in ROM 82 is developed when main CPU 80 executes various programs, or used as a working memory. HDD 84 is an auxiliary storage storing various data including programs and image data. HDD 84 stores date of initial operation of image forming apparatus 10, contact information of a service center including telephone number, facsimile number and electronic mail address of the service center that dispatches service engineers, and image data related to an engine diagnosis sheet and a counter information sheet, which will be described later. HDD 84 further stores latest date of replacement, latest date of cleaning, timing of replacement when replacement is due and timing of cleaning when cleaning is due, procedures of replacement and cleaning, model number, method of order of each of the components as the objects of maintenance, total number of prints, and the number of prints from the latest replacement of toner cartridge, in association with the corresponding component as the object of maintenance, as maintenance object component information. The latest date of replacement and the latest date of cleaning of the component as the object of maintenance are input by the user or the service engineer, after conducting the maintenance work, through operation panel 91. The total number of prints, and the number of prints after the latest replacement of toner cartridge are input from counter 93. The timing of replacement is information indicating the time period from the latest date of replacement to the next date of replacement. The timing of cleaning is information indicating the time period from the latest date of cleaning to the next date of cleaning. The timing of replacement and the timing of cleaning are set in advance in accordance with the user mode and the service engineer mode.

In the present embodiment, in ROM 82 or HDD 84, in addition to a program for realizing general operations of image forming apparatus 10, a program for realizing the automatic maintenance notifying process and the manual maintenance notifying process is stored. Here, the automatic maintenance notifying process refers to an operation of automatically notifying the user about the component as the object of maintenance, procedure of maintenance work and the like in the user mode, and automatically notifying the user that maintenance by a service engineer is necessary and contact address and the like of a service center, in the service engineer mode. The manual maintenance notifying process refers to a process for notifying the user about the component as the object of maintenance, the procedure of maintenance work, the state of the apparatus and the like in response to a user instruction. The program is provided from an external device through a network 85 and an NIC (Network Interface Card) 86. The program may be provided on a recording medium such as a DVD, on which the program is recorded. Specifically, the DVD as a program recording medium may be mounted on a DVD drive (not shown) built in image forming apparatus 10, and the program may be read from the DVD and installed in HDD 84. The program structure for realizing the automatic maintenance notifying process and the manual maintenance notifying process in the program will be described later.

Main CPU 80 executes the image forming process and other desired process including communication with an external device, of image forming apparatus 10, by executing various computer programs. The above-described programs are stored in advance in ROM 82 or HDD 84, and when a desired process is executed, the program is read from ROM 82 or HDD 84 and transferred to RAM 83. Main CPU 80 reads and interprets a program instruction from an address in RAM 83, designated by a value stored in a register called a program counter, not shown, in main CPU 80. Further, main CPU 80 reads data necessary for an operation from the address designated by the read instruction, and executes the operation corresponding to the instruction on the data. The result of execution is also stored at an address designated by the instruction, in RAM 83, HDD 84 or the register in main CPU 80.

To main CPU 80, various components of image forming apparatus 10 described above, including a sub CPU-A 87 controlling an operation of document reading unit 14, a sub CPU-B 88, an image processing unit 89, an image memory 90, operation panel 91, a calendar timer 92, a counter 93 and the like, as well as an NIC (Network Interface Card) 86 for providing an interface with a network 85 implemented by LAN (Local Area Network) line, are electrically connected through bus line 81.

Sub CPU-A 87 controls an operation of document reading unit 14. Sub CPU-B 88 controls an operation of the image forming unit including image forming station 22, LSU 24, the transfer unit and fixing unit 50. Image memory 90 temporarily stores image data. Calendar timer 92 outputs current date information to main CPU 80. Counter 93 counts the number of prints printed by the image forming unit, and outputs the count information to main CPU 80.

Image forming apparatus 10 is capable of communication with an external device such as a client personal computer (hereinafter referred to as a "client PC") 95 and a management server 94 on network 85, through NIC 86. Management server 94 obtains information such as a jam rate in image forming apparatus 10, and based on the obtained information, determines the maintenance method to be set in image forming apparatus 10. Then, based on the determined method of maintenance, it transmits a method designating signal including the information for designating the maintenance method, to image forming apparatus 10.

As described above, main CPU 80 controls operations of various components of image forming apparatus 10 including sub CPU-A 87, sub CPU-B 88, image processing unit 89, image memory 90, operation panel 91, calendar timer 92 and counter 93, and thereby sequence-controls image forming apparatus 10, to execute the image forming process and other desired processes including communication with the external devices, of image forming apparatus 10.

<Software Configuration>

(Automatic Maintenance Notifying Process)

The program for realizing the automatic maintenance notifying process in image forming apparatus 10 is activated when the power of image forming apparatus 10 is turned on. When image forming apparatus 10 is powered on, an initial setting image is displayed including various operation keys, for receiving a user instruction related to various processes to be performed by image forming apparatus 10, on the display unit of operation panel 91.

Figure 4:
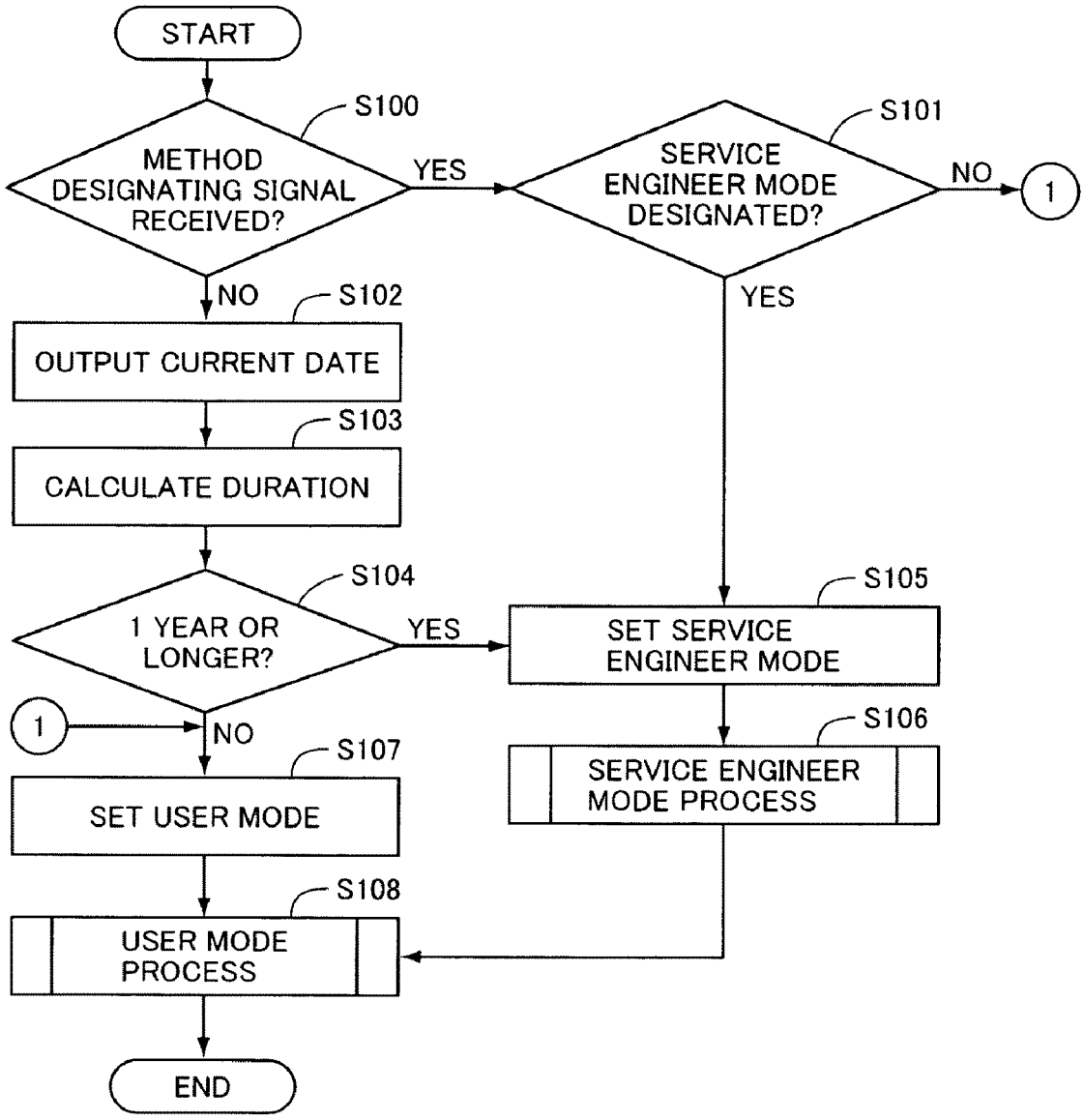
FIG. 4 shows, in the form of a flowchart, a program structure for realizing an automatic maintenance notifying process in the image forming apparatus.

Referring to FIG. 4, the program includes: a step S100 of monitoring NIC 86, determining whether or not NIC 86 has received the method designating signal including information for designating the maintenance method from management server 94, and branching control flow depending on the result of determination; and a step S101, executed if it is determined at step S100 that the method designating signal has been received (YES), of determining whether or not the service engineer mode is designated by the method designating signal, and branching control flow depending on the result of determination.

The program further includes: a step S102, executed if it is determined at step S100 that the method designating signal has not been received (NO), of causing calendar timer 92 to output the current date; a step S103 of calculating the duration of use of the apparatus based on the current date output from calendar timer 92 and the date of initial operation of image forming apparatus 10 stored in advance in HDD 84; and a step S104 of determining whether or not the calculated duration has reached one year as a predetermined threshold value, and branching control flow depending on the result of determination.

The program further includes: a step S105, executed if it is determined at step S104 that the duration has reached one year (YES), or if it is determined at step S101 that the service engineer mode is designated (YES), of setting the maintenance method to the service engineer mode; and a step S160 of executing the service engineer mode process, which will be described later.

The program further includes: a step S107, executed if it is determined at step S104 that the duration has not reached one year (NO), or if it is determined at step S101 that the service engineer mode is not designated (NO), of setting the maintenance mode to the user mode; and a step S108 of executing the user mode process, which will be described later.

Figure 5:
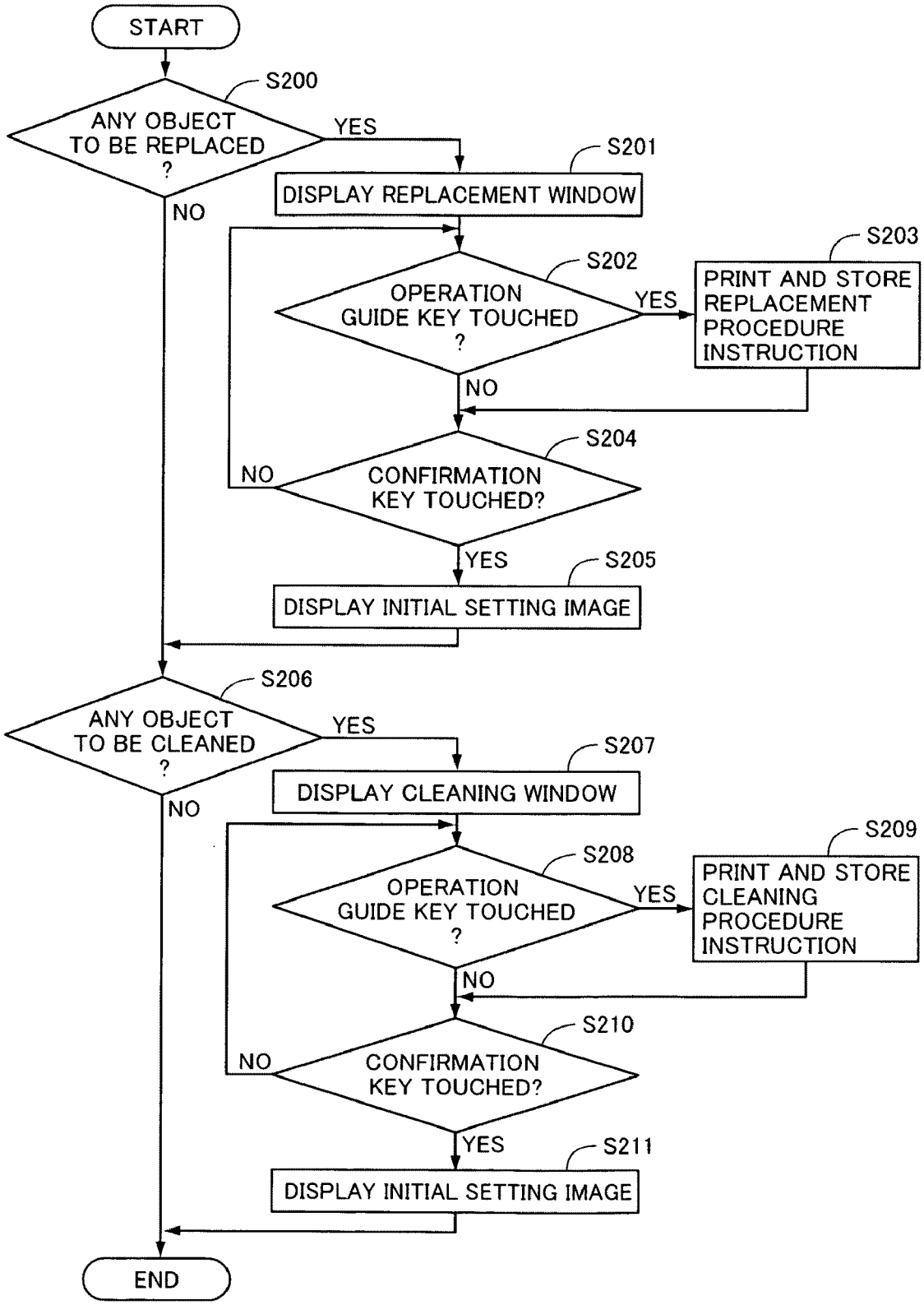
FIG. 5 is a more detailed flowchart of a user mode process performed at step S108 shown in FIG. 4.

Referring to FIG. 5, the program for realizing the user mode process includes: a step S200 of determining, based on the current date output from calendar timer 92, the timing of replacement when replacement is due and the latest date of replacement of components as the objects of maintenance stored in HDD 84, whether there is any component as the object of maintenance of which timing of replacement has passed (hereinafter referred to as an "object to be replaced"), and branching control flow depending on the result of determination; and a step S201, executed if it is determined at step S200 that there is an object to be replaced (YES), of displaying a replacement window to notify about the object to be replaced, on the display unit of operation panel 91, in accordance with the result of determination.

Figure 6:
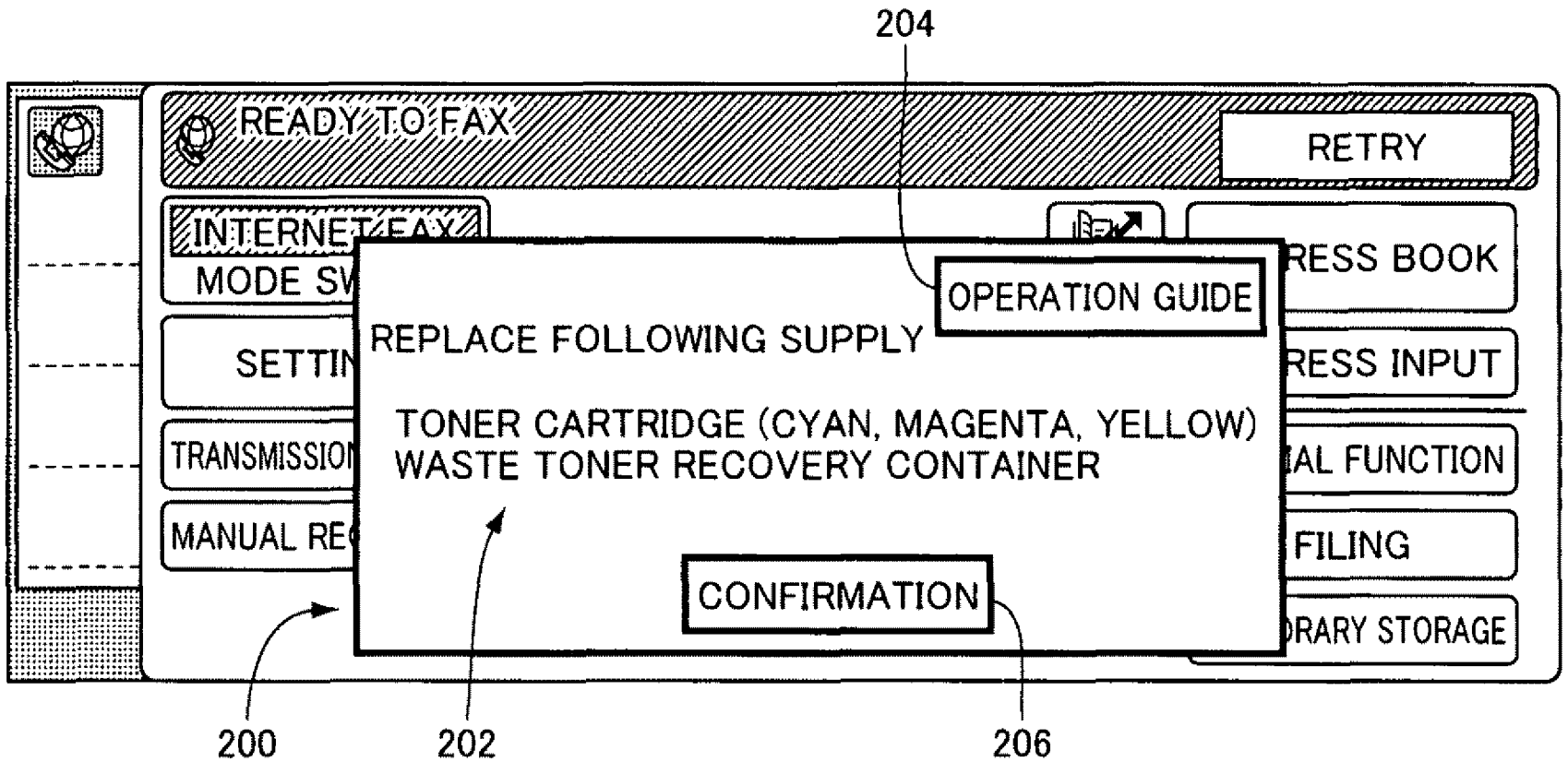
FIG. 6 shows an example of a replacement window displayed when timing for replacing a toner cartridge and a waste toner recovery container has passed.

Referring to FIG. 6, a replacement window 200 includes a message 202 notifying about the object to be replaced, an operation guide key 204 receiving an instruction to print a replacement procedure instruction, including information related to the replacement procedure, model number and how to order the object to be replaced, and a confirmation key 206 for receiving an instruction to end the display of replacement window 200.

The program further includes: a step S202 of determining whether or not operation guide key 204 of replacement window 200 has been touched, and branching control flow depending on the result of determination; and a step S203, executed if it is determined at step S202 that operation guide key 204 has been touched (YES), of operating various components of image forming apparatus 10 to print the corresponding replacement procedure instruction, and storing image data corresponding to the output image, in image memory 90. The replacement procedure instruction is formed based on the maintenance object component information stored in HDD 84.

The program further includes: a step S204, executed if it is determined at step S202 that operation guide key 204 is not touched (NO), or executed after the process of step S203, of determining whether or not the confirmation key 206 on replacement window 200 has been touched, and branching control flow depending on the result of determination; and a step S205, executed if it is determined at step S204 that confirmation key 206 has been touched (YES), of ending the display of replacement window 200 and displaying the initial setting image. If it is determined at step S204 that confirmation key 206 is not touched (NO), control returns to step S202.

The program further includes a step S206, executed if it is determined at step S200 that there is no object to be replaced (NO), or executed after the process of step S205, of determining, based on the current date output from calendar timer 92 and on the latest date of cleaning and the timing of cleaning when cleaning is due, of components as the objects of maintenance stored in HDD 84, whether there is any component as the object of maintenance of which timing of cleaning has passed (hereinafter referred to as an object to be cleaned"), and branching control flow depending on the result of determination; and a step S207, executed if it is determined at step S206 that there is an object to be cleaned (YES), of displaying a cleaning window for notifying about the object to be cleaned, at the display unit of operation panel 91, in accordance with the result of determination.

Figure 7:
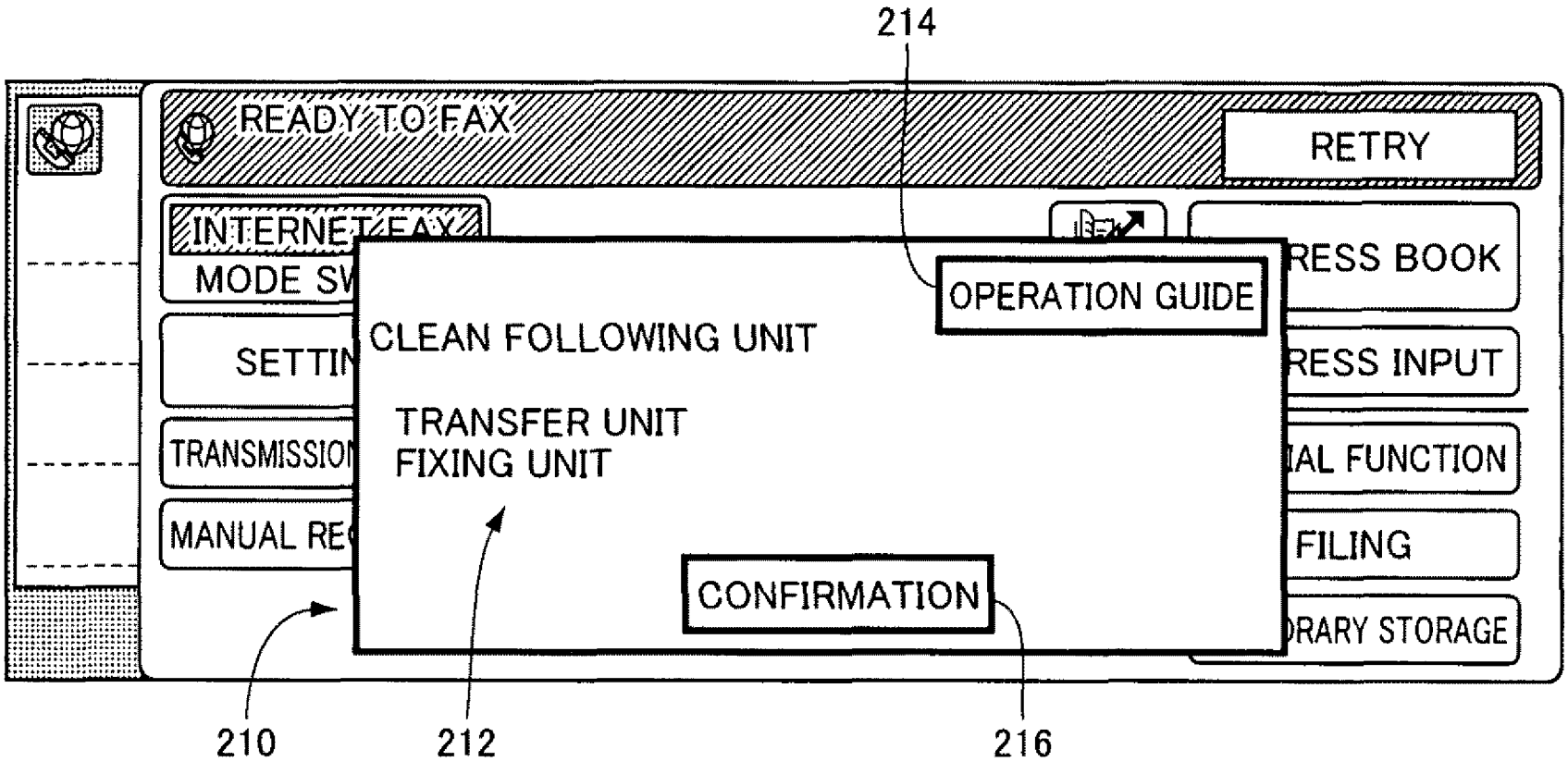
FIG. 7 shows an example of a cleaning window displayed when timing for cleaning a transfer unit and a fixing unit has passed.

Referring to FIG. 7, cleaning window 210 includes a message 212 notifying of the name of the object to be cleaned, an operation guide key 214 for receiving an instruction to print a cleaning procedure instruction, including information related to the procedure for cleaning the object to be cleaned, and a confirmation key 216 for receiving an instruction to end the display of cleaning window 210.

The program further includes: a step S208 of determining whether or not operation guide key 214 on cleaning window 210 has been touched, and branching control depending on the result of determination; and a step S209, executed if it is determined at step S208 that operation guide key 214 has been touched (YES), of operating various components of image forming apparatus 10 to print the corresponding cleaning procedure instruction, and storing the image data corresponding to the output image in image memory 90. The cleaning procedure instruction is formed based on the maintenance object component information stored in HDD 84.

The program further includes: a step S210, executed if it is determined at step S208 that operation guide key 214 has not been touched (NO), or executed after the process of step S209, of determining whether or not confirmation key 216 of cleaning window 210 has been touched, and branching control flow depending on the result of determination; and a step S211, executed if it is determined at step S210 that confirmation key 216 has been touched (YES), of ending the display of cleaning window 210 and displaying the initial setting image. If it is determined at step S210 that confirmation key 216 has not been touched (NO), control returns to step S208.

Figure 8:
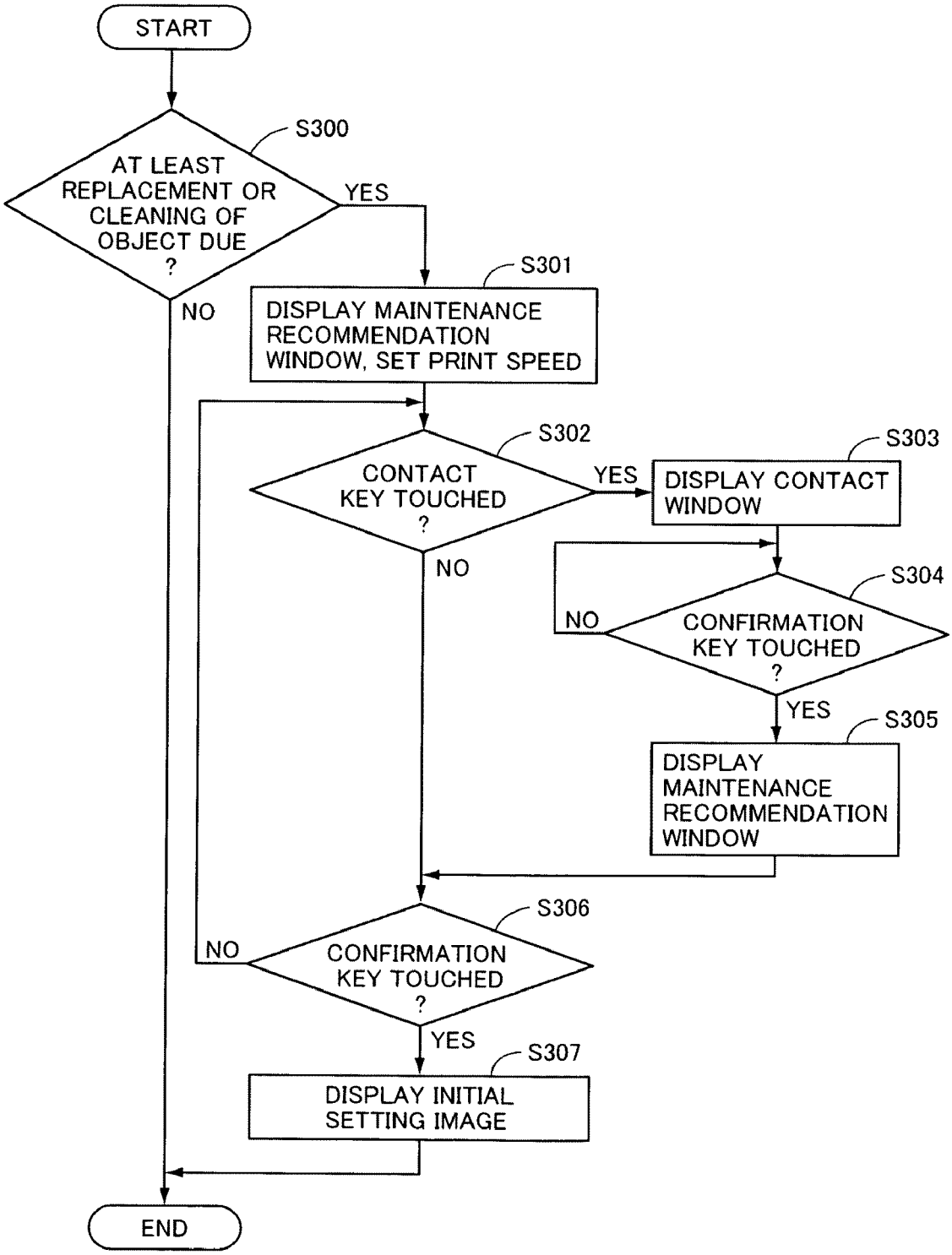
FIG. 8 is a more detailed flowchart of a service engineer mode process performed at step S106 shown in FIG. 4.

Referring to FIG. 8, the program for realizing the service engineer mode process includes: a step S300 of determining, based on the current date output from calendar timer 92, the latest date of replacement and timing of replacement of the components as the objects of maintenance stored in HDD 84, and on the latest date of cleaning and the timing of cleaning of the components as the objects of maintenance stored in HDD 84, whether there is any object to be replaced or to be cleaned, and branching control flow depending on the result of determination; and a step S301, executed if it is determined at step S300 that there is at least an object to be replaced or to be cleaned (YES), of displaying a maintenance recommendation window urging a call for maintenance to a service center on the display unit of operation panel 91, and setting speed of printing such that the speed of printing at the image forming unit becomes slower than at present.

Figure 9:
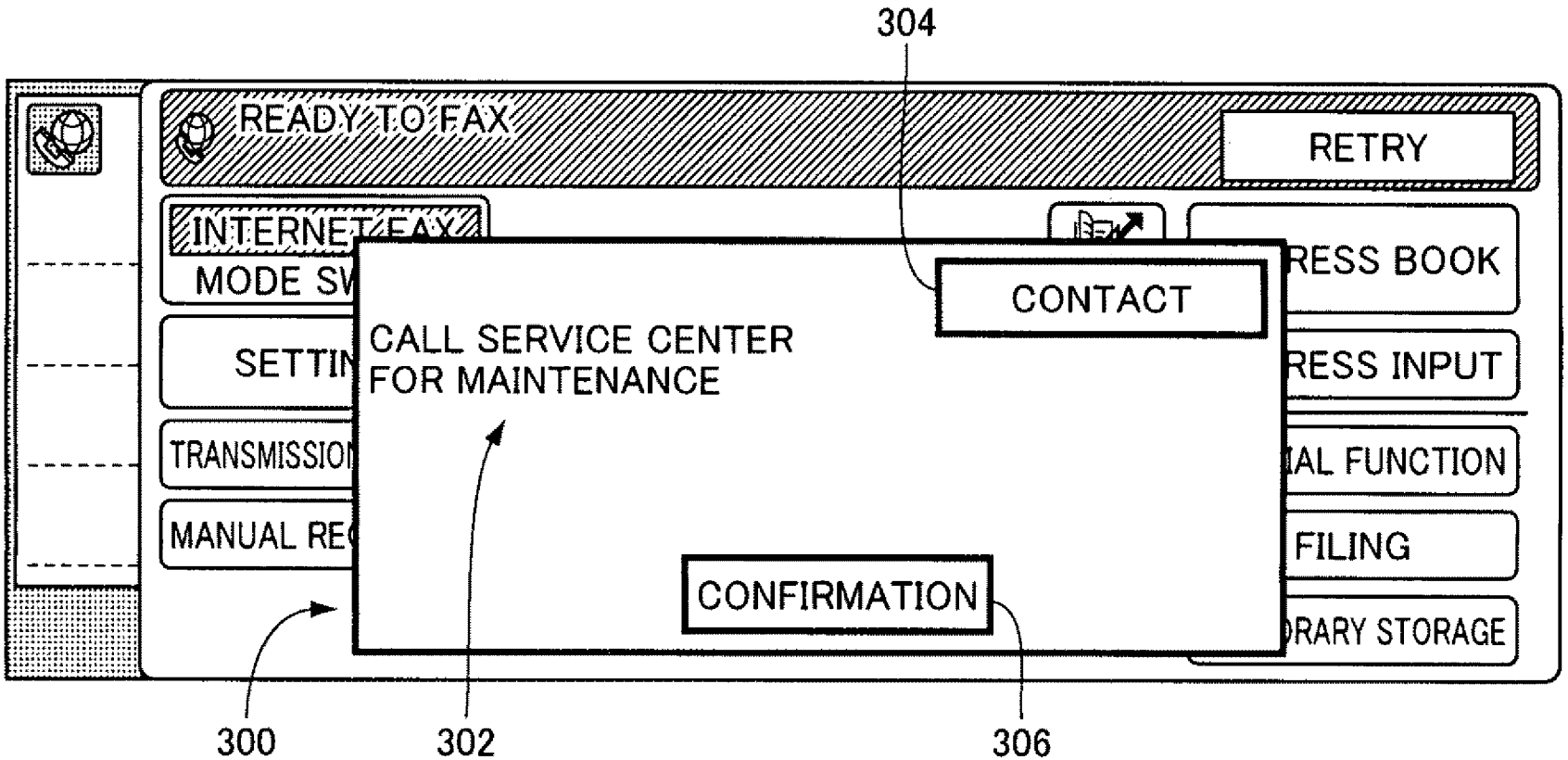
FIG. 9 shows an example of a maintenance recommendation window.

Referring to FIG. 9, maintenance recommendation window 300 includes a message 302 urging a call for maintenance to the service center, a contact key 304 for receiving an instruction to display a contact address of the service center, and a confirmation key 306 for receiving an instruction to end display of the maintenance recommendation window 300.

The program further includes: a step S302 of determining whether or not contact key 304 on maintenance recommendation window 300 has been touched, and branching control flow depending on the result of determination; and a step S303, executed if it is determined at step S302 that contact key 304 has been touched (YES), of displaying a contact window (not shown) on the display unit of operation panel 91. The contact window includes, for example, a message indicating contact information of the service center, such as a telephone number, facsimile number and electronic mail address of the service center, and a confirmation key for receiving an instruction to end the display of contact window.

The program further includes: a step S304 of waiting, after the process of step S303, until the confirmation key on the contact window is touched; and a step S305, executed if it is determined at step S304 that the confirmation key on the contact window has been touched (YES), of ending the display of contact window and displaying maintenance recommendation window 300.

The program further includes a step S306, executed if it is determined at step S302 that contact key 304 has not been touched (NO), or executed after the process of step S305, of determining whether or not confirmation key 306 on maintenance recommendation window 300 has been touched, and branching control flow depending on the result of determination. If it is determined at step S306 that confirmation key 306 is not touched (NO), control returns to step S302.

The program further includes a step S307, executed if it is determined at step S306 that confirmation key 306 on maintenance recommendation window 300 has been touched (YES), of ending display of maintenance recommendation window 300 and displaying the initial setting image.

When a service engineer finishes the maintenance work, he/she sets the speed of printing such that the speed of printing operation at the image forming unit is returned to the original speed. In this manner, when the service engineer mode is set and there is at least an object to be replaced or to be cleaned, the speed of printing operation is set slower, so that the user can more acutely recognize the necessity of maintenance.

(Manual Maintenance Notifying Process)

Figure 10A:
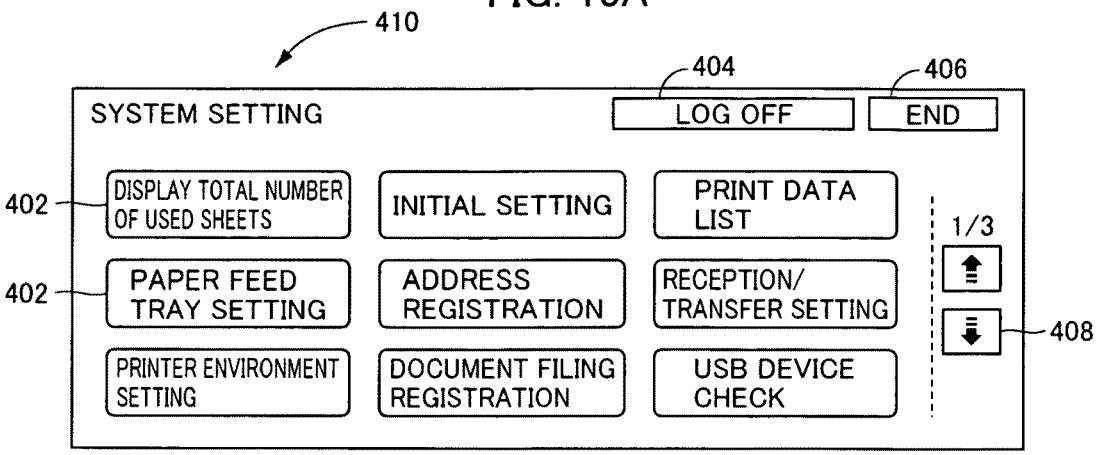
FIGS. 10A to 10C show examples of system setting images.
Figure 10B:
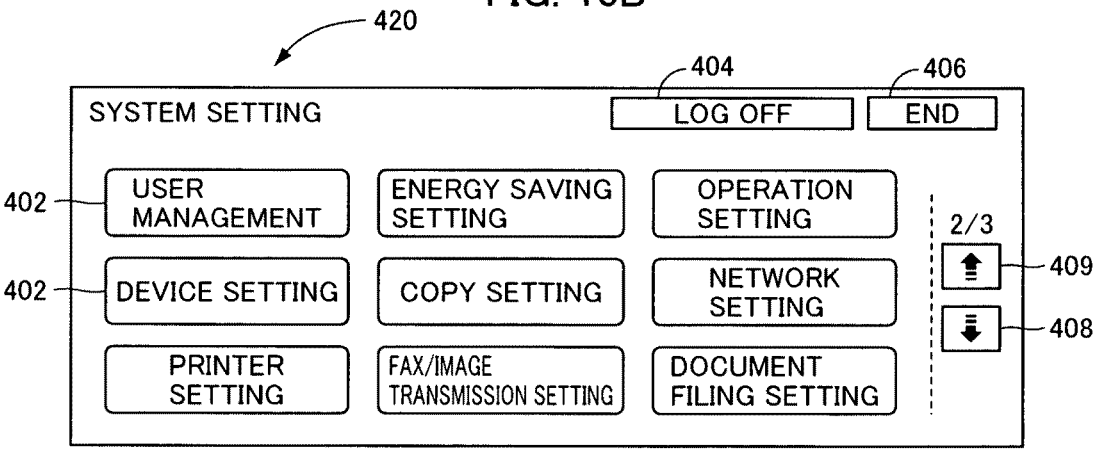
Figure 10C:
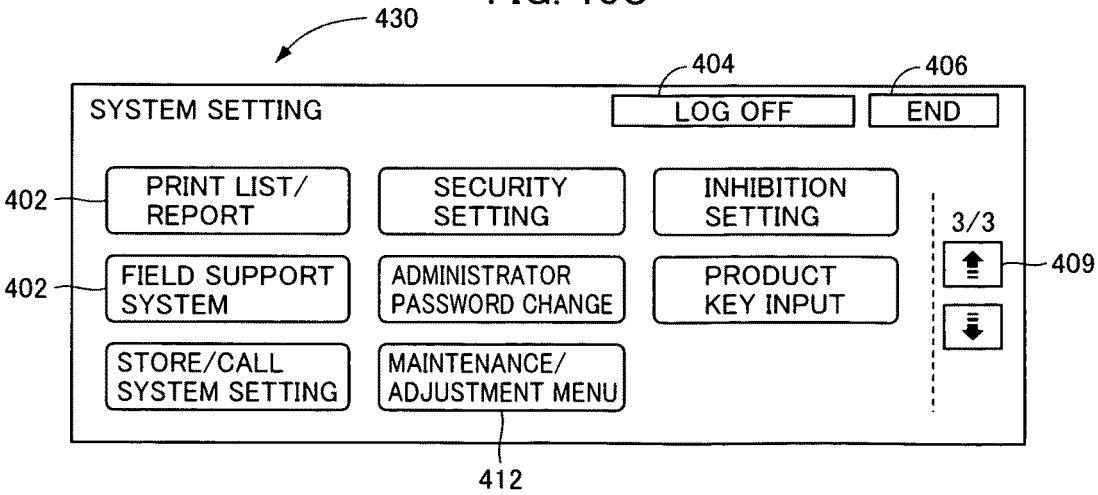

Referring to FIGS. 10A to 10C, system setting images 410, 420 and 430 have the same structures except that contents of processing corresponding to operation keys 402 differ from each other.

System setting images 410, 420 and 430 include: various operation keys 402 for receiving user instructions related to various processes; a log-off key 404 and an end key 406 for receiving an instruction to end display of system setting images 410, 420 and 430; a next image key 408 for receiving an instruction to display the next image; and a previous image key 409 for receiving an instruction to display the previous image.

System setting image 410 is displayed on the display unit of operation panel 91, in response to the user touching a system setting key (not shown) on the initial setting image. System setting image 420 is displayed on the display unit of operation panel 91, in response to the user touching next image key 408 on system setting image 410, or touching previous image key 409 on system setting image 430. System setting image 430 is displayed on the display unit of operation panel 91, in response to the user touching next image key 408 on system setting image 420.

In the present embodiment, system setting image 430 includes, as one of the various operation keys 402, a maintenance/adjustment key 412. Maintenance/adjustment key 412 is displayed only when the user mode is set in the automatic maintenance notifying process described above, and it is not displayed when the service engineer mode is set. Since the maintenance/adjustment key 412 is not displayed in the service engineer mode, more reliable maintenance work by the service engineer becomes possible.

The program for realizing the manual maintenance notifying process in image forming apparatus 10 is activated when maintenance/adjustment key 412 on system setting image 430 is touched.

Figure 11:
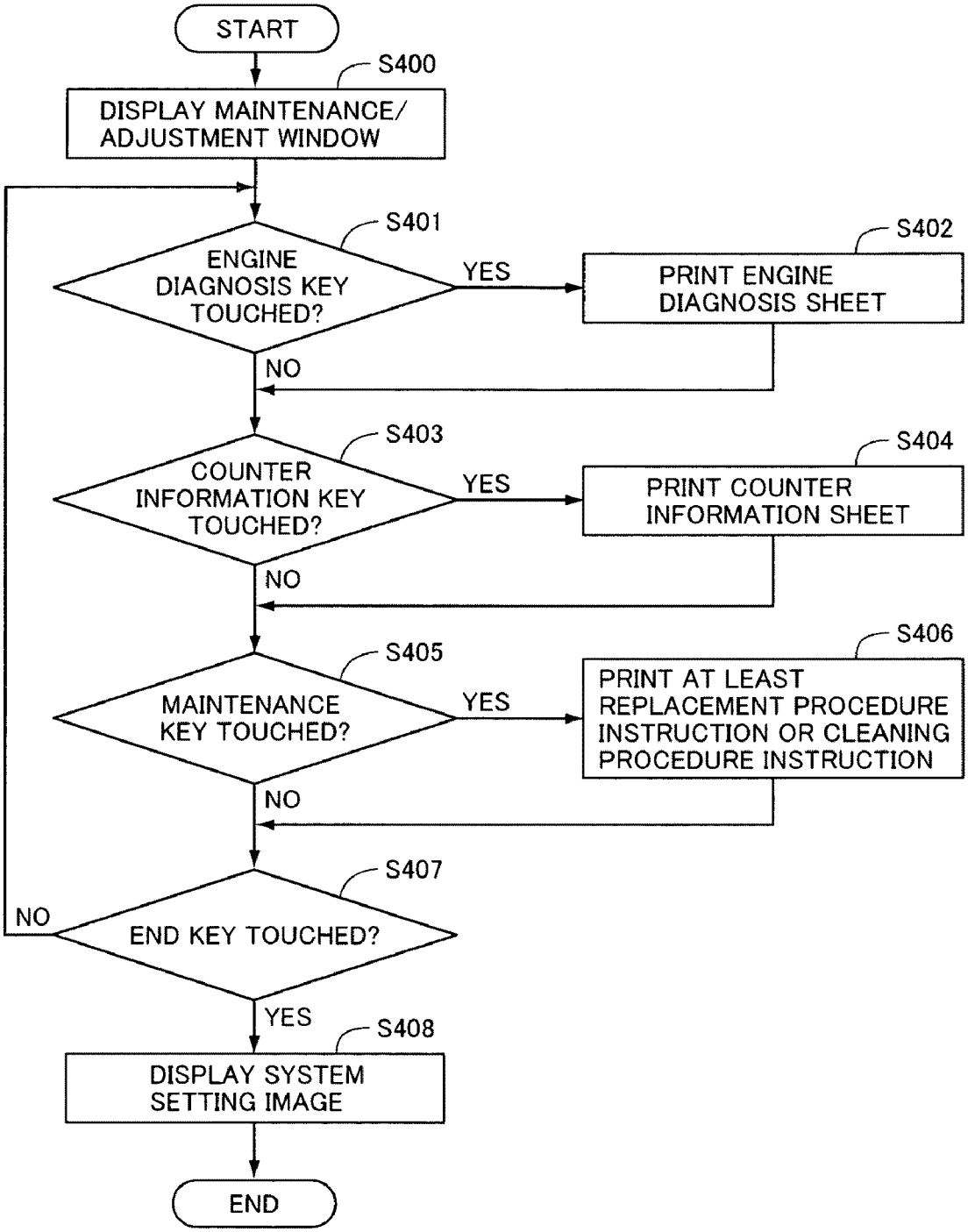
FIG. 11 shows, in the form of a flowchart, a program structure for realizing the manual maintenance notifying process in the image forming apparatus.
Figure 12:
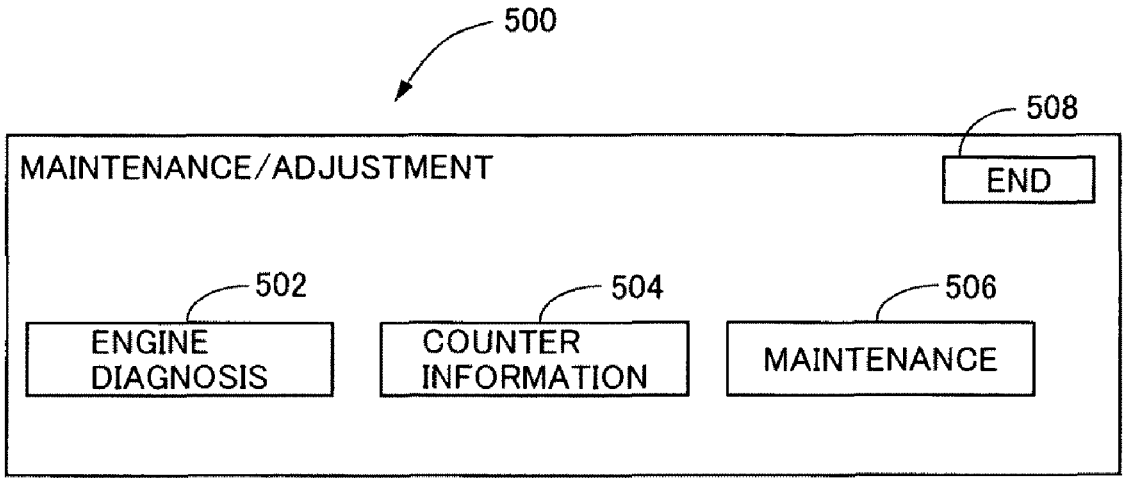
FIG. 12 shows an example of a maintenance/adjustment window.

Referring to FIG. 11, the program includes a step S400 of displaying a maintenance/adjustment window for notifying about the contents of processing in accordance with the maintenance/adjustment menu, on the display unit of operation panel 91. Referring to FIG. 12, maintenance/adjustment window 500 includes an engine diagnosis key 502 for receiving an instruction to print an engine diagnosis sheet, a counter information key 504 for receiving an instruction to print a counter information sheet, a maintenance key 506 for receiving an instruction to print at least a replacement procedure instruction corresponding to the object to be replaced or a cleaning procedure instruction corresponding to the object to be cleaned, and an end key 508 for receiving an instruction to end display of maintenance/adjustment window 500.

Figure 13A:
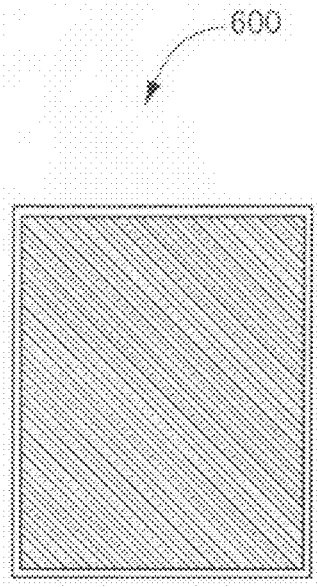
FIG. 13A shows an example of an engine diagnosis sheet.
Figure 13B:
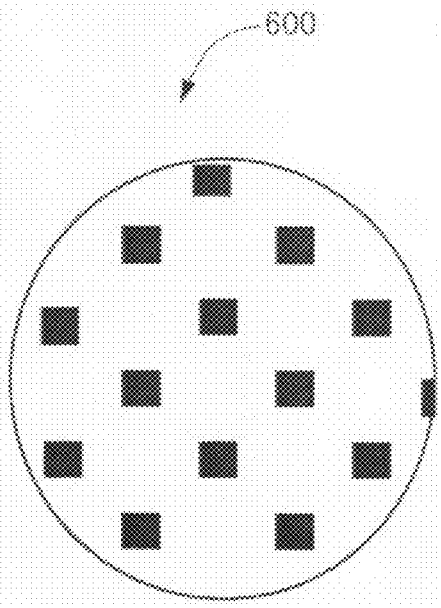
FIG. 13B shows, in enlargement, a part of the engine diagnosis sheet of FIG. 13A.

The program further includes: a step S401 of determining whether or not the engine diagnosis key 502 on maintenance/adjustment window 500 has been touched, and branching control flow depending on the result of determination; and a step S402, executed if it is determined at step S401 that engine diagnosis key 502 has been touched (YES), of operating various components of image forming apparatus 10 and printing the engine diagnosis sheet. Referring to FIGS. 13A and 13B, engine diagnosis sheet 600 is a print test pattern printed for each single color of cyan, magenta, yellow and black. Based on the printed engine diagnosis sheet 600, the user can inspect any defect in tone gradation or density of printing, and he/she can determine whether or not a toner cartridge, developer unit 64 or the like requires maintenance.

The program further includes: a step S403, executed if it is determined at step S401 that engine diagnosis key 502 has not been touched (NO), or executed after the process of step S402, of determining whether or not counter information key 504 on maintenance/adjustment window 500 has been touched, and branching control flow depending on the result of determination; and a step S404, executed if it is determined at step S403 that counter information key 504 has been touched (YES), of operating various components of image forming apparatus 10 and printing the counter information sheet. Here, the counter information sheet is a printed sheet of counter information including the total number of prints, the number of prints from the latest replacement of toner cartridge, the latest date of replacement of toner cartridge and of waste toner recovery container 78, and the latest date of cleaning of the transfer unit, fixing unit 50 and developer unit 64. By inspecting the printed counter information sheet, the user can determine whether each component as the object of maintenance requires maintenance. The counter information sheet is formed based on the maintenance object component information stored in HDD 84.

The program further includes: a step S405, executed if it is determined at step S403 that counter information key 504 has not been touched (NO), or executed after the process of step S404, of determining whether or not maintenance key 506 on maintenance/adjustment window 500 has been touched, and branching control flow depending on the result of determination; and a step S406, executed if it is determined at step S405 that maintenance key 560 has been touched (YES), of operating various components of image forming apparatus 10 and printing at least the replacement procedure instruction corresponding to the object to be replaced or the cleaning procedure instruction corresponding to the object to be cleaned, stored in image memory 90 in the automatic maintenance notifying process described above. By inspecting at least the replacement procedure instruction corresponding to the object to be replaced or the cleaning procedure instruction corresponding to the object to be cleaned, stored in image memory 90 in the automatic maintenance notifying process described above, the user can identify the object to be replaced and the object to be cleaned, and to know information such as the procedure to be done on the object component.

The program further includes: a step S407 of determining whether or not end key 508 on maintenance/adjustment window 500 has been touched and branching control flow depending on the result of determination; and a step S408, executed if it is determined at step S407 that end key 508 has been touched (YES), of ending display of maintenance/adjustment window 500 and displaying the system setting image. If it is determined at step S407 that end key 508 has not been touched (NO), control returns to step S401.

<Operation>

Referring to FIGS. 1 to 13, image forming apparatus 10 in accordance with the present embodiment operates in the following manner, in the automatic maintenance notifying process and in the manual maintenance notifying process. General operations including the image forming operation of image forming apparatus 10 are the same as those of a conventional image forming apparatus.

(Operation in Automatic Maintenance Notifying Process)

—When Duration is Shorter than One Year—

First, an operation when the duration of image forming apparatus 10 is shorter than one year will be described. In this example, management server 94 does not transmit the method designating signal to image forming apparatus 10.

First, the user turns on the power of image forming apparatus 10. When the power is turned on, an initial setting image (not shown) including various operation keys for receiving user instructions related to various processes to be conducted by image forming apparatus 10 is displayed on the display unit of operation panel 91. It is noted that setting of maintenance method was cancelled when the power was turned off at the end of previous use.

Determining that NIC 86 has not received the method designating signal from management server 94, main CPU 80 causes calendar timer 92 to output the current date. Based on the output current date and the date of initial operation of image forming apparatus 10 stored in advance in HDD 84, duration of use of the apparatus is calculated, and whether the calculated duration has reached one year as the predetermined threshold value or not is determined. Here, main CPU 80 determines that the calculated duration of use has not reached one year, and sets the user mode as the maintenance method, whereby the user mode process as described below starts.

When the user mode process starts, main CPU 80 determines, based on the current date output from calendar timer 92 and the latest date of replacement and the timing of replacement of components as the objects of maintenance stored in HDD 84, whether there is any object to be replaced. If there is any, in accordance the result of determination, the replacement window is displayed to notify about the object of replacement, on the display unit of operation panel 91. In this example, it is determined that the toner cartridge and waste toner recovery container 78 are the objects to be replaced, and replacement window 200 shown in FIG. 6 is displayed.

When the user checks replacement window 200 and touches operation guide key 204 on replacement window 200, main CPU 80 operates various components of image forming apparatus 10 so that the corresponding replacement procedure instruction is printed, and the image data corresponding to the output image is stored in image memory 90.

When the user obtains the replacement procedure instruction and touches confirmation key 206 on replacement window 200, main CPU 80 ends the display of replacement window 200, and displays the initial setting image. Further, based on the current date output from calendar timer 92 and the latest date of cleaning and the timing of cleaning of components as the objects of maintenance stored in HDD 84, main CPU 80 determines whether there is any object to be cleaned. If there is any, in accordance with the result of determination, the cleaning window is displayed to notify about the object of cleaning, on the display unit of operation panel 91. In this example, it is determined that the transfer unit and fixing unit 50 are the objects to be cleaned, and cleaning window 210 shown in FIG. 7 is displayed.

When the user checks cleaning window 210 and touches operation guide key 214 on cleaning window 210, main CPU 80 operates various components of image forming apparatus 10 so that the corresponding cleaning procedure instruction is printed, and the image data corresponding to the output image is stored in image memory 90.

When the user obtains the cleaning procedure instruction and touches confirmation key 216 on cleaning window 210, main CPU 80 ends the display of cleaning window 210, and displays the initial setting image. Thus, the user mode process in the automatic maintenance notifying process ends.

—When Duration is One Year or Longer—

Next, an operation when the duration of use of image forming apparatus 10 is one year or longer will be described. In this example, management server 94 does not transmit the method designating signal to image forming apparatus 10.

First, the user turns on the power of image forming apparatus 10. When the power is turned on, an initial setting image (not shown) including various operation keys for receiving user instructions related to various processes to be conducted by image forming apparatus 10 is displayed on the display unit of operation panel 91. It is noted that setting of maintenance method was cancelled when the power was turned off at the end of previous use.

Determining that NIC 86 has not received the method designating signal from management server 94, main CPU 80 causes calendar timer 92 to output the current date. Based on the output current date and the date of initial operation of image forming apparatus 10 stored in advance in HDD 84, duration of use of the apparatus is calculated, and whether or not the calculated duration has reached one year as the predetermined threshold value is determined. Here, main CPU 80 determines that the calculated duration of use has reached one year, and sets the service engineer mode as the maintenance method, whereby the service engineer mode process as described below starts.

When the service engineer mode process starts, main CPU 80 determines, based on the current date output from calendar timer 92 and the latest date of replacement and the timing of replacement of components as the objects of maintenance, as well as the latest date of cleaning and the timing of cleaning of components as the objects of maintenance, stored in HDD 84, whether there is at least an object to be replaced or an object to be cleaned. If it is determined that there is at least an object to be replaced or an object to be cleaned, the maintenance recommendation window urging a call for maintenance to the service center is displayed on the display unit of operation panel 91, and the speed of printing for the printing operation at the image forming unit is set to be slower than the current speed. In this example, maintenance recommendation window 300 shown in FIG. 9 is displayed.

When the user checks maintenance recommendation window 300 and touches contact key 304 on maintenance recommendation window 300, main CPU 80 displays the contact window (not shown) on the display unit of operation panel 91.

When the user checks the contact window and touches the confirmation key on the contact window, main CPU 80 ends the display of contact window and displays the maintenance recommendation window 300.

When the user checks maintenance recommendation window 300 and touches confirmation key 306 on maintenance recommendation window 300, main CPU 80 ends the display of maintenance recommendation window 300 and displays the initial setting image. Thus, the service engineer mode process in the automatic maintenance notifying process ends.

(Operation in Manual Maintenance Notifying Process)

When the user mode is set as the maintenance method, the user can execute the following manual maintenance notifying process.

When the user touches the system setting key (not shown) on the initial setting image to display system setting image 430 on the display unit of operation panel 91 and then touches maintenance/adjustment key 412 on system setting image 430, main CPU 80 displays a maintenance/adjustment window notifying about the contents of processing of maintenance/adjustment menu, on the display unit of operation panel 91. In this example, maintenance/adjustment window 500 shown in FIG. 12 is displayed.

When the user checks maintenance/adjustment window 500 and touches engine diagnosis key 502 on maintenance/adjustment window 500, main CPU 80 operates various components of image forming apparatus 10, whereby an engine diagnosis sheet (see FIGS. 13A and 13B) is printed.

When the user obtains the engine diagnosis sheet and touches counter information key 504 of maintenance/adjustment window 500, main CPU 80 operates various components of image forming apparatus 10, whereby a counter information sheet is printed.

When the user obtains the counter information sheet and touches maintenance key 506 on maintenance/adjustment window 500, main CPU 80 operates various components of image forming apparatus 10 so that at least the replacement procedure instruction corresponding to the object to be replaced or the cleaning procedure instruction corresponding to the object to be cleaned, stored in image memory 90 at the time of automatic maintenance notifying process described above, is printed. In this example, the toner cartridge and waste toner recovery container 78 are the objects to be replaced and the transfer unit and fixing unit 50 are the objects to be cleaned. Therefore, the replacement procedure instruction and the cleaning procedure instruction corresponding to these objects are printed.

When the user obtains the replacement procedure instruction and the cleaning procedure instruction and touches end key 508 on maintenance/adjustment window 500, main CPU 80 ends the display of maintenance/adjustment window 500, and displays the system setting image. Thus, the manual maintenance notifying process ends.

<Functions/Effects>

According to the present embodiment, in image forming apparatus 10 of which maintenance work is conducted in accordance with the user mode or the service engineer mode, the image forming unit including image forming station 22 and the like prints an image in accordance with the image data on a recording medium, and main CPU 80 calculates duration of use of the apparatus as an index indicating degradation with time, and determines whether or not the calculated duration of use of the apparatus has reached one year as a predetermined threshold value. Based on the result of determination, the user mode or the service engineer mode is set as the method of maintenance for conducting the maintenance work.

As described above, since the user mode or the service engineer mode is set based on whether the duration of use of the apparatus as an index of degradation with time has reached one year as the predetermined threshold, it becomes possible to always conduct appropriate maintenance work independent of the time-degradation of the apparatus.

Further, according to the embodiment, in image forming apparatus 10, main CPU 80 detects a timing when at least replacement or cleaning of an object is necessary, that is, the timing when maintenance work is due, in accordance with the set maintenance method. If the timing when maintenance work is due is detected, at least the replacement window 200 or the cleaning window 210 is displayed on the display unit of operation panel 91.

As described above, if the timing when at least replacement or cleaning of an object is due is detected, replacement window 200 or cleaning window 210 is displayed and, therefore, it is possible for the user to easily notice that there is an object to be replaced or an object to be cleaned. Therefore, it is possible to always conduct appropriate maintenance work such as object replacement and object cleaning with higher reliability.

Further, according to the present embodiment, if it is determined that the duration of use of the apparatus as an index indicating degradation with time has reached one year as the predetermined threshold value, main CPU 80 sets the service engineer mode, and if it is determined that the duration has not yet reached one year, it sets the user mode. Therefore, it is possible to always conduct more appropriate maintenance work independent of the time-degradation of the apparatus.

Further, according to the present embodiment, when the user mode is set and the timing when at least replacement or cleaning of an object is due is detected, main CPU 80 displays operation guide keys 204 and 214 on the display unit of operation panel 91, to receive an instruction to print at least the replacement procedure instruction or the cleaning procedure instruction. Therefore, it is possible to always conduct more appropriate maintenance work independent of the time-degradation of the apparatus.

Further, according to the present embodiment, when the service engineer mode is set, main CPU 80 decreases the speed of printing by the image forming unit. Thus, the user more strongly feels the necessity of maintenance. Therefore, convenience of use of the apparatus can further be improved.

More preferably, main CPU 80 sets the user mode or the service engineer mode based on a method designating signal received from management server 94.

As described above, the user mode or the service engineer mode is set based on a designation from the external device and, therefore, it is always possible to conduct more appropriate maintenance work independent of time-degradation of the apparatus or other conditions.

In the above-described embodiments, the index indicating time-degradation is the duration of use of the apparatus. The present invention, however, is not limited to such an embodiment. By way of example, the number of prints formed by the image forming unit may be used. If the index indicating time-degradation is the duration of use of the apparatus, it becomes possible to always conduct an appropriate maintenance work independent of the duration of use of the apparatus. If the index is the number of prints provided by the image forming unit, it becomes possible to always conduct an appropriate maintenance work independent of the number of prints.

Further, in the embodiments above, replacement window 200 and cleaning window 210 include messages 202 and 212, operation guide keys 204 and 214, and confirmation keys 206 and 216. The present invention, however, is not limited to such embodiments. For example, in addition to the pieces of information mentioned above, contact information such as a telephone number of a support center may be included, for inquiry related to the maintenance work.

Further, in the embodiments above, maintenance/adjustment key 412 is not displayed when the service engineer mode is set. The present invention, however, is not limited to such an embodiment. For example, when the service engineer mode is set, the key may be displayed only on the setting image for the service engineer, used by the engineer.

Further, in the embodiments described above, the automatic maintenance notifying process is executed every time the power of image forming apparatus 10 is turned on. The present invention, however, is not limited to such an embodiment. By way of example, it may be executed at every prescribed time interval.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

What is claimed is:

1. An image forming apparatus, of which maintenance work is conducted in accordance with any of a plurality of maintenance methods, comprising:

an output device printing an image on a recording medium in accordance with image data;

a calculating unit calculating a value as an index indicating degradation with time;

a determining unit determining whether or not the value calculated by said calculating unit has reached a predetermined threshold value; and a setting unit setting, based on the result of determination by said determining unit, any of said plurality of maintenance methods as the maintenance method of conducting said maintenance work; and a receiving unit receiving an instruction from an external device designating said maintenance method; wherein said setting unit includes a method setting circuit setting any of said plurality of maintenance methods as the maintenance method of conducting said maintenance work, based on the instruction from said external device.

2. The image forming apparatus according to claim 1, wherein said calculating unit includes a calculating circuit calculating duration of use of the apparatus as the index indicating degradation with time.

3. The image forming apparatus according to claim 1, wherein said calculating unit includes a calculating circuit calculating quantity of prints by said output device as the index indicating degradation with time.

4. The image forming apparatus according to claim 1, further comprising:

a detecting unit detecting a timing when the maintenance work is due, in accordance with said maintenance method set by said setting unit;

a display device displaying information; and a display control unit causing said display device to display information related to the set maintenance method, if a timing when said maintenance work is due is detected by said detecting unit.

5. The image forming apparatus according to claim 4, wherein said detecting unit includes a detecting circuit detecting, as the timing when said maintenance work is due, at least a timing when a component is to be replaced, or a component is to be cleaned; and said display control unit includes a control circuit causing said display device to display information related at least to replacement or cleaning of a component, if at least the timing when a component is to be replaced or the timing when a component is to be cleaned is detected by said detecting circuit.

6. The image forming apparatus according to claim 4, wherein said setting unit includes a setting circuit for setting, as the maintenance method of conducting said maintenance work, a user mode in which the user conducts the maintenance work, among said plurality of maintenance methods, and said display control unit causes said display device to display information related to work procedure of said maintenance, when said user mode is set as the maintenance method of conducting said maintenance work by said setting circuit and the timing when said maintenance work is due is detected by said detecting unit.

7. An image forming apparatus, of which maintenance work is conducted in accordance with any of a plurality of maintenance methods, comprising:

an output device printing an image on a recording medium in accordance with image data;

a calculating unit calculating a value as an index indicating degradation with time;

a determining unit determining whether or not the value calculated by said calculating unit has reached a predetermined threshold value; and a setting unit setting, based on the result of determination by said determining unit, any of said plurality of maintenance methods as the maintenance method of conducting said maintenance work, wherein said setting unit includes a setting circuit setting, as the maintenance method of conducting said maintenance work, either a user mode in which the user conducts the maintenance work, or a service engineer mode in which a service engineer as an expert conducts the maintenance work, among said plurality of maintenance methods, based on a result of determination by said determining unit.

8. The image forming apparatus according to claim 7, wherein said setting circuit sets said service engineer mode as the maintenance method of conducting said maintenance work if it is determined by said determining unit that the value calculated by said calculating unit has reached the predetermined threshold value, and sets said user mode as the maintenance method of conducting said maintenance work if it is determined by said determining unit that the value calculated by said calculating unit has not yet reached the predetermined threshold value.

9. The image forming apparatus according to claim 7, further comprising a control unit controlling an operation of said output device; wherein said control unit decreases speed of printing operation by said output device, when said service engineer mode is set as the maintenance method of conducting said maintenance work by said setting circuit.

10. The image forming apparatus according to claim 7, further comprising a receiving unit receiving an instruction from an external device designating said maintenance method; wherein said setting unit includes a method setting circuit setting any of said plurality of maintenance methods as the maintenance method of conducting said maintenance work, based on the instruction from said external device.

11. The image forming apparatus according to claim 7, wherein said calculating unit includes a calculating circuit calculating duration of use of the apparatus as the index indicating degradation with time.

12. The image forming apparatus according to claim 7, wherein said calculating unit includes a calculating circuit calculating quantity of prints by said output device as the index indicating degradation with time.

13. The image forming apparatus according to claim 7, further comprising:

a detecting unit detecting a timing when the maintenance work is due, in accordance with said maintenance method set by said setting unit;

a display device displaying information; and a display control unit causing said display device to display information related to the set maintenance method, if a timing when said maintenance work is due is detected by said detecting unit.

14. The image forming apparatus according to claim 13, wherein said detecting unit includes a detecting circuit detecting, as the timing when said maintenance work is due, at least a timing when a component is to be replaced, or a component is to be cleaned; and said display control unit includes a control circuit causing said display device to display information related at least to replacement or cleaning of a component, if at least the timing when a component is to be replaced or the timing when a component is to be cleaned is detected by said detecting circuit.

15. The image forming apparatus according to claim 13, wherein said display control unit causes said display device to display information related to work procedure of said maintenance, when said user mode is set as the maintenance method of conducting said maintenance work by said setting circuit and the timing when said maintenance work is due is detected by said detecting unit.

* * * * *